US010301842B2

(12) United States Patent
Volin

(10) Patent No.: US 10,301,842 B2
(45) Date of Patent: May 28, 2019

(54) UNIQUE SELF-LOCKING SELF-CENTERING BRACKET-CLAMP FENCE SYSTEM, HAVING SELF-LOCKING SELF-CENTERING BRACKET-CLAMP SYSTEM, BOARD-EXPANSION-INTERNAL-GAP POST SYSTEM, AND BOARD-EXPANSION-INTERNAL-GAP RAIL SYSTEM

(71) Applicant: Dee Volin, Fairview, OR (US)

(72) Inventor: Dee Volin, Fairview, OR (US)

( * ) Notice: Subject to any disclaimer, the term of this patent is extended or adjusted under 35 U.S.C. 154(b) by 577 days.

(21) Appl. No.: 15/099,587

(22) Filed: Apr. 14, 2016

(65) Prior Publication Data

US 2016/0305150 A1 Oct. 20, 2016

Related U.S. Application Data

(60) Provisional application No. 62/148,345, filed on Apr. 16, 2015.

(51) Int. Cl.
*E04H 17/14* (2006.01)
*E04H 17/00* (2006.01)

(52) U.S. Cl.
CPC ... *E04H 17/1421* (2013.01); *E04H 2017/006* (2013.01); *E04H 2017/1465* (2013.01)

(58) Field of Classification Search
CPC ..... E04H 17/1413; E04H 17/1421; E04H 17/1434; E04H 17/1443; E04H 2017/006;
(Continued)

(56) References Cited

U.S. PATENT DOCUMENTS 3,062,573 A 11/1962 Roecker
3,144,265 A 8/1964 Humble
(Continued)

FOREIGN PATENT DOCUMENTS

DE 20 2012 103 687 * 11/2013 ..... E04B 2/56
EP 2 113 618 * 11/2009 ..... E04F 11/18
FR 2 958 674 * 10/2011 ..... E04H 17/14

*Primary Examiner* — Michael P Ferguson

(57) ABSTRACT

A unique springable hand-free-self-locking self-centering bracket-clamp fence system comprises fence-post base systems, fence-post systems, springable hand-free-self-locking self-centering bracket-clamp systems, board-expansion-internal-gap rail systems, stackable interlocking fence-board systems, and fence-post-covering cap systems. The fence-post base systems are for supporting the fence-post systems, respectively. The fence-post systems are for supporting the board-expansion-internal-gap rail systems, respectively. The board-expansion-internal-gap rail systems are for supporting the stackable interlocking fence-board systems, respectively. The fence-post-covering cap systems are for preventing water penetration to the inside of the fence-post systems, respectively. The fence-post systems have multiple bracket-clamp-locking jaw slots and multiple bracket-clamp-centering grooves. The springable hand-free-self-locking self-centering bracket-clamp systems have springable hand-free-self-locking self-centering bracket-clamp jaws for locking the springable hand-free-self-locking self-centering bracket-clamp systems in the multiple bracket-clamp-locking jaw slots respectively, springable hand-free-self-locking self-centering bracket-clamp teeth for biting into the multiple bracket-clamp-locking jaw slots respectively, and springable hand-free-self-locking self-centering bracket-clamp groove, for centering the springable hand-free-self-locking self-centering bracket-clamp systems in the multiple bracket-clamp-centering grooves respectively, to center the stackable inter-
(Continued)

locking fence-board systems in the fence-post systems, respectively, and to offer unique privacy.

20 Claims, 32 Drawing Sheets

(58) Field of Classification Search
CPC .... E04H 2017/1447; E04H 2017/1452; E04H 2017/1456
See application file for complete search history.

(56) References Cited

U.S. PATENT DOCUMENTS

| | | | | |
|---|---|---|---|---|
| 3,601,430 | A | | 8/1971 | Zwennis |
| 4,077,611 | A | | 3/1978 | Wilson |
| 4,114,861 | A | | 9/1978 | Long |
| 4,280,686 | A | | 7/1981 | Wack |
| 4,369,953 | A | * | 1/1983 | Greiner ..... E04H 17/143 256/24 |
| 4,616,950 | A | | 10/1986 | Morris |
| 4,936,550 | A | | 6/1990 | Wickham |
| D310,780 | S | | 9/1990 | Kelley |
| 4,982,932 | A | | 1/1991 | Baker |
| 5,186,571 | A | | 2/1993 | Hentzschel |
| 5,238,321 | A | | 8/1993 | Jarjoura |
| 5,362,030 | A | | 11/1994 | Iler, Jr. |
| 5,383,739 | A | | 1/1995 | Haglund |
| 5,439,201 | A | | 8/1995 | Landreville |
| 5,603,580 | A | | 2/1997 | Leek |
| 5,653,546 | A | | 8/1997 | Cronkhite |
| 5,702,090 | A | * | 12/1997 | Edgnnan ..... E04H 17/1421 256/19 |
| 5,795,503 | A | | 8/1998 | Krake |
| 6,053,481 | A | | 4/2000 | Scheide |
| 6,543,751 | B1 | | 4/2003 | Spruill |
| 6,619,627 | B2 | | 9/2003 | Salisbury |
| 6,705,598 | B2 | | 3/2004 | Collins |
| 6,883,785 | B1 | | 4/2005 | Knapp |
| 6,896,437 | B2 | | 5/2005 | Morgan |
| 6,935,623 | B2 | | 8/2005 | Cook |
| 7,007,363 | B2 | | 3/2006 | Forbis |
| 7,048,259 | B2 | | 5/2006 | Quaintance |
| 7,070,136 | B1 | | 7/2006 | Bailey |
| 7,121,530 | B1 | | 10/2006 | Preta |
| 7,125,002 | B2 | | 10/2006 | Platt |
| 7,168,688 | B2 | | 1/2007 | Davenport |
| 7,216,855 | B2 | | 5/2007 | Platt |
| 7,992,841 | B2 | | 8/2011 | Petta |
| 8,047,485 | B2 | | 11/2011 | McGinness |
| 8,210,504 | B1 | | 7/2012 | Skornickel |
| 8,308,140 | B2 | | 11/2012 | Boukal |
| 8,480,061 | B2 | | 7/2013 | Graves |
| 8,505,880 | B2 | | 8/2013 | Langenwalter |
| D737,124 | S | | 8/2015 | Sasanecki |
| 9,151,074 | B2 | | 10/2015 | Walters |
| 9,181,725 | B2 | | 11/2015 | Roddy |
| 9,228,372 | B2 | | 1/2016 | Bertato |
| 9,234,367 | B2 | | 1/2016 | Kopp |
| 2004/0206028 | A1 | | 10/2004 | Terrels |
| 2009/0238640 | A1 | | 9/2009 | Godwin |
| 2010/0155683 | A1 | | 6/2010 | Payne |
| 2010/0237308 | A1 | | 9/2010 | Lo |
| 2010/0252793 | A1 | | 10/2010 | Ash |
| 2010/0270526 | A1 | | 10/2010 | Erwin |
| 2011/0001105 | A1 | | 1/2011 | Lo |

* cited by examiner

UNIQUE SELF-LOCKING SELF-CENTERING BRACKET-CLAMP FENCE SYSTEM, HAVING SELF-LOCKING SELF-CENTERING BRACKET-CLAMP SYSTEM, BOARD-EXPANSION-INTERNAL-GAP POST SYSTEM, AND BOARD-EXPANSION-INTERNAL-GAP RAIL SYSTEM

1. FIELD OF THE INVENTION

The present invention relates to a bracket fence system for attaching fence boards to a fence post. Particularly, the present invention relates to a unique self-locking self-centering bracket-clamp fence system, which has:

a) Fence-post base systems,
b) Fence-post systems,
c) Springable hand-free-self-locking self-centering bracket-clamp systems,
d) Board-expansion-internal-gap rail systems,
e) Stackable interlocking fence-board systems, and
f) Fence-post-covering cap systems.

to eliminate the needs for having multiple persons to install a fence,
to speed up the fence-installing process,
to save time and money,
to eliminate personal injuries during the fence installation, etc.

2. DESCRIPTION OF THE PRIOR ART

A number of bracket fence systems have been introduced.

U.S. Pat. No. 3,062,573 issued 1962 Nov. 6, to Earl E. Roecker;
U.S. Pat. No. 3,144,265 issued 1964 Aug. 11, to F. E. Humble;
U.S. Pat. No. 3,601,430 issued 1971 Aug. 24, to Hendrik P. Zwennis;
U.S. Pat. No. 4,077,611 issued 1978 Mar. 7, to Robert M. Wilson;
U.S. Pat. No. 4,114,861 issued 1978 Sep. 19, to Clyde A. Long;
U.S. Pat. No. 4,280,686 issued 1981 Jul. 28, to David T. Wack;
U.S. Pat. No. 4,616,950 issued 1986 Oct. 14, to Tom C. Morris;
U.S. Pat. No. 4,936,550 issued 1990 Jun. 26, to Richard J. Wickham;
U.S. Pat. No. 4,982,932 issued 1991 Jan. 8, to Wayne Baker;
U.S. Pat. No. 5,186,571 issued 1993 Feb. 16, to Walter G. Hentzschel;
U.S. Pat. No. 5,238,321 issued 1993 Aug. 24, to Michael Jarjoura;
U.S. Pat. No. 5,362,030 issued 1994 Nov. 8, to Ralph K. Iler, Jr.;
U.S. Pat. No. 5,383,739 issued 1995 Jan. 24, to Vernon Haglund;
U.S. Pat. No. 5,439,201 issued 1995 Aug. 8, to Charles Landreville;
U.S. Pat. No. 5,603,580 issued 1997 Feb. 18, to William F. Leek;
U.S. Pat. No. 5,653,546 issued 1997 Aug. 5, to Carol M. Cronkhite;
U.S. Pat. No. 5,795,503 issued 1998 Aug. 18, to Christopher P. Krake;
U.S. Pat. No. 6,053,481 issued 2000 Apr. 25, to James W. Scheide;

U.S. Pat. No. 6,543,751 issued 2003 Apr. 8, to James F. Spruill;
U.S. Pat. No. 6,619,627 issued 2003 Sep. 16, to Gordon L. Salisbury;
U.S. Pat. No. 6,705,598 issued 2004 Mar. 16, to Charles R. Collins;
U.S. Pat. No. 6,883,785 issued 2005 Apr. 26, to David M. Knapp;
U.S. Pat. No. 6,896,437 issued 2005 May 24, to John Morgan;
U.S. Pat. No. 6,935,623 issued 2005 Aug. 30, to James C. Cook;
U.S. Pat. No. 7,007,363 issued 2006 Mar. 7, to John T. Forbis;
U.S. Pat. No. 7,048,259 issued 2006 May 23, to Randy R. Quaintance;
U.S. Pat. No. 7,070,136 issued 2006 Jul. 4, to Richard D. Bailey;
U.S. Pat. No. 7,121,530 issued 2006 Oct. 17, to John Preta;
U.S. Pat. No. 7,125,002 issued 2006 Oct. 24, to Robert E. Platt;
U.S. Pat. No. 7,168,688 issued 2007 Jan. 30, to David R. Davenport;
U.S. Pat. No. 7,216,855 issued 2007 May 15, to Robert E. Platt;
U.S. Pat. No. 7,992,841 issued 2011 Aug. 9, to Gabriel Petta;
U.S. Pat. No. 8,047,485 issued 2011 Nov. 1, to William McGinness;
U.S. Pat. No. 8,210,504 issued 2012 Jul. 3, to Anthony J. Skornickel;
U.S. Pat. No. 8,308,140 issued 2012 Nov. 13, to Josef A. Boukal;
U.S. Pat. No. 8,480,061 issued 2013 Jul. 9, to Thomas L. Graves;
U.S. Pat. No. 8,505,880 issued 2013 Aug. 13, to Duane Langenwalter;
U.S. Pat. No. 9,151,074 issued 2015 Oct. 6, to Craig Walters;
U.S. Pat. No. 9,181,725 issued 2015 Nov. 10, to Kenneth J Roddy;
U.S. Pat. No. 9,228,372 issued 2016 Jan. 5, to Maurizio C. Bertato;
U.S. Pat. No. 9,234,367 issued 2016 Jan. 12, to Michael Kopp;
U.S. Pat. No. D310,780 issued 1990 Sep. 25, to Donald W. Kelley;
U.S. Pat. No. D737,124 issued 2015 Aug. 25, to John Sasanecki;
U.S. Publication No. 20040206028 issued 2004 Oct. 21, to Christopher J. Terrels;
U.S. Publication No. 20090238640 issued 2009 Sep. 24, to Aaron Godwin;
U.S. Publication No. 20100155683 issued 2010 Jun. 24, to John F. Payne;
U.S. Publication No. 20100237308 issued 2010 Sep. 23, to Chong-Yi Lo;
U.S. Publication No. 20100252793 issued 2010 Oct. 7, to Gary W. Ash;
U.S. Publication No. 20100270526 issued 2010 Oct. 28, to Ronald D. Erwin; and
U.S. Publication No. 20110001105 issued 2011 Jan. 6, to Chong-Yi Lo disclose a variety of inventions related to bracket fence systems.

DISADVANTAGES OF THE PRIOR ART

The prior art have failed to solve many problems associated with such bracket fence system, as follows:

1) No prior art mention or disclose any bracket fence system, having
first bracket-clamp-locking jaw slot 113.
Therefore, the prior art of bracket fence system:
a) Can not squeeze springable hand-free-self-locking self-centering bracket-clamp jaws 127 therein; and
b) Can not lock springable hand-free-self-locking self-centering bracket-clamp jaws 127 therein.

2) No prior art mention or disclose any bracket fence system, having
second bracket-clamp-locking jaw slot 117.
Therefore, the prior art of bracket fence system:
a) Can not squeeze springable hand-free-self-locking self-centering bracket-clamp jaws 127 therein; and
b) Can not lock springable hand-free-self-locking self-centering bracket-clamp jaws 127 therein.

3) No prior art mention or disclose any bracket fence system, having
first bracket-clamp-centering groove 114.
Therefore, the prior art of bracket fence system:
a) Can not center springable hand-free-self-locking self-centering bracket-clamp groove 129 therein;
b) Can not center springable hand-free-self-locking self-centering bracket-clamp teeth 128 therein;
c) Can not center springable hand-free-self-locking self-centering bracket-clamp jaws 127 therein;
d) Can not center springable hand-free-self-locking self-centering bracket-clamp body 126 therein;
e) Can not center springable hand-free-self-locking self-centering bracket-clamp system 125 therein;
f) Can not center board-expansion-internal-gap rail systems 134; and
g) Can not center stackable interlocking fence-board systems 141.

4) No prior art mention or disclose any bracket fence system, having
second bracket-clamp-centering groove 118.
Therefore, the prior art of bracket fence system:
a) Can not center springable hand-free-self-locking self-centering bracket-clamp groove 129 therein;
b) Can not center springable hand-free-self-locking self-centering bracket-clamp teeth 128 therein;
c) Can not center springable hand-free-self-locking self-centering bracket-clamp jaws 127 therein;
d) Can not center springable hand-free-self-locking self-centering bracket-clamp body 126 therein;
e) Can not center springable hand-free-self-locking self-centering bracket-clamp system 125 therein;
f) Can not center board-expansion-internal-gap rail systems 134; and
g) Can not center stackable interlocking fence-board systems 141.

5) No prior art mention or disclose any bracket fence system, having
springable hand-free-self-locking self-centering bracket-clamp jaws 127.
Therefore, the prior art of bracket fence system:
a) Can not be squeezed into jaw slot 113, 117, or 121;
b) Can not springably and temporarily secure springable hand-free-self-locking self-centering bracket-clamp system 125 in place, to eliminate the need for holding it while screwing it to fence-post system 108;
c) Can not reduce fence-installing time, by eliminating the need for manually holding springable hand-free-self-locking self-centering bracket-clamp system 125 while installing the unique hand-free-springable self-locking self-centering bracket-clamp fence system; and
d) Can not function as a springably locking washer to springably lock springable hand-free-self-locking self-centering bracket-clamp screw 133 to fence-post system 108.

6) No prior art mention or disclose any bracket fence system, having
springable hand-free-self-locking self-centering bracket-clamp teeth 128.
Therefore, the prior art of bracket fence system:
a) Can not bite into jaw slot 113, 117, or 121, to lock springable hand-free-self-locking self-centering bracket-clamp systems 125 therein at any desired elevation; and
b) Can not bite into jaw slot 113, 117, or 121, to eliminate the needs for having a person to hold springable hand-free-self-locking self-centering bracket-clamp systems 125 therein at any desired elevation.

7) No prior art mention or disclose any bracket fence system, having
springable hand-free-self-locking self-centering bracket-clamp groove 129.
Therefore, the prior art of bracket fence system:
a) Can not slide in bracket-clamp-centering groove 114, 118, or 122;
b) Can not center springable hand-free-self-locking self-centering bracket-clamp teeth 128 therein;
c) Can not center springable hand-free-self-locking self-centering bracket-clamp jaws 127 therein;
d) Can not center springable hand-free-self-locking self-centering bracket-clamp body 126 therein; and
e) Can not center springable hand-free-self-locking self-centering bracket-clamp system 125 therein.

8) No prior art mention or disclose any bracket fence system, having
U-shaped-rail board-expansion internal gap 140.
Therefore, the prior art of bracket fence system:
a) Can not accommodate expansion and contraction of stackable interlocking fence-board systems 141 inside u-shaped-rail board-expansion internal gap 140 of board-expansion-internal-gap rail system 134, to prevent stackable interlocking fence-board systems 141 from warping, bending, and breaking;
b) Can not allow deep insertion of stackable interlocking fence-board systems 141 into u-shaped-rail board-expansion internal gap 140 of board-expansion-internal-gap rail system 134, to reinforce the unique springable hand-free-self-locking self-centering bracket-clamp fence system;
c) Can not support stackable interlocking fence-board systems 141; and
d) Can not lock stackable-interlocking-fence-board ridge 146 therein.

OBJECTS AND ADVANTAGES OF THE INVENTION

The new invention substantially departs from the conventional concepts and designs of the prior art. In doing so, the new invention provides a
unique springable hand-free-self-locking self-centering bracket-clamp fence system having many unique and significant features, functions, and advantages, which overcome all the disadvantages of the prior art, as follows:

1) It is an object of the new invention to provide a unique springable hand-free-self-locking self-centering bracket-clamp fence system, having
first bracket-clamp-locking jaw slot 113.
Therefore, the unique springable hand-free-self-locking self-centering bracket-clamp fence system:
a) Can squeeze springable hand-free-self-locking self-centering bracket-clamp jaws 127 therein; and
b) Can lock springable hand-free-self-locking self-centering bracket-clamp jaws 127 therein.

2) It is another object of the new invention to provide a unique springable hand-free-self-locking self-centering bracket-clamp fence system, having
second bracket-clamp-locking jaw slot 117.
Therefore, the unique springable hand-free-self-locking self-centering bracket-clamp fence system:
a) Can squeeze springable hand-free-self-locking self-centering bracket-clamp jaws 127 therein; and
b) Can lock springable hand-free-self-locking self-centering bracket-clamp jaws 127 therein.

3) It is a further object of the new invention to provide a unique springable hand-free-self-locking self-centering bracket-clamp fence system, having
first bracket-clamp-centering groove 114.
Therefore, the unique springable hand-free-self-locking self-centering bracket-clamp fence system:
a) Can center springable hand-free-self-locking self-centering bracket-clamp groove 129 therein;
b) Can center springable hand-free-self-locking self-centering bracket-clamp teeth 128 therein;
c) Can center springable hand-free-self-locking self-centering bracket-clamp jaws 127 therein;
d) Can center springable hand-free-self-locking self-centering bracket-clamp body 126 therein;
e) Can center springable hand-free-self-locking self-centering bracket-clamp system 125 therein;
f) Can center board-expansion-internal-gap rail systems 134; and
g) Can center stackable interlocking fence-board systems 141.

4) It is an even further object of the new invention to provide a unique springable hand-free-self-locking self-centering bracket-clamp fence system, having
second bracket-clamp-centering groove 118.
Therefore, the unique springable hand-free-self-locking self-centering bracket-clamp fence system:
a) Can center springable hand-free-self-locking self-centering bracket-clamp groove 129 therein;
b) Can center springable hand-free-self-locking self-centering bracket-clamp teeth 128 therein;
c) Can center springable hand-free-self-locking self-centering bracket-clamp jaws 127 therein;
d) Can center springable hand-free-self-locking self-centering bracket-clamp body 126 therein;
e) Can center springable hand-free-self-locking self-centering bracket-clamp system 125 therein;
f) Can center board-expansion-internal-gap rail systems 134; and
g) Can center stackable interlocking fence-board systems 141.

5) It is another object of the new invention to provide a unique springable hand-free-self-locking self-centering bracket-clamp fence system, having
springable hand-free-self-locking self-centering bracket-clamp jaws 127.
Therefore, the unique springable hand-free-self-locking self-centering bracket-clamp fence system:
a) Can be squeezed into jaw slot 113, 117, or 121;
b) Can springably and temporarily secure springable hand-free-self-locking self-centering bracket-clamp system 125 in place, to eliminate the need for holding it while screwing it to fence-post system 108;
c) Can reduce fence-installing time, by eliminating the need for manually holding springable hand-free-self-locking self-centering bracket-clamp system 125 while installing the unique hand-free-springable self-locking self-centering bracket-clamp fence system; and
d) Can function as a springably locking washer to springably lock springable hand-free-self-locking self-centering bracket-clamp screw 133 to fence-post system 108.

6) It is yet another object of the new invention to provide a unique springable hand-free-self-locking self-centering bracket-clamp fence system, having
springable hand-free-self-locking self-centering bracket-clamp teeth 128.
Therefore, the unique springable hand-free-self-locking self-centering bracket-clamp fence system:
a) Can bite into jaw slot 113, 117, or 121,
to lock springable hand-free-self-locking self-centering bracket-clamp systems 125 therein at any desired elevation; and
b) Can bite into jaw slot 113, 117, or 121,
to eliminate the needs for having a person to hold springable hand-free-self-locking self-centering bracket-clamp systems 125 therein at any desired elevation.

7) It is still yet another object of the new invention to provide a unique springable hand-free-self-locking self-centering bracket-clamp fence system, having
springable hand-free-self-locking self-centering bracket-clamp groove 129.
Therefore, the unique springable hand-free-self-locking self-centering bracket-clamp fence system:
a) Can slide in bracket-clamp-centering groove 114, 118, or 122;
b) Can center springable hand-free-self-locking self-centering bracket-clamp teeth 128 therein;
c) Can center springable hand-free-self-locking self-centering bracket-clamp jaws 127 therein;
d) Can center springable hand-free-self-locking self-centering bracket-clamp body 126 therein; and
e) Can center springable hand-free-self-locking self-centering bracket-clamp system 125 therein.

8) It is still yet an even further object of the new invention to provide a unique springable hand-free-self-locking self-centering bracket-clamp fence system, having
U-shaped-rail board-expansion internal gap 140.
Therefore, the unique springable hand-free-self-locking self-centering bracket-clamp fence system:
a) Can accommodate expansion and contraction of stackable interlocking fence-board systems 141 inside u-shaped-rail board-expansion internal gap 140 of board-expansion-internal-gap rail system 134, to prevent stackable interlocking fence-board systems 141 from warping, bending, and breaking;
b) Can allow deep insertion of stackable interlocking fence-board systems 141 into u-shaped-rail board-expansion internal gap 140 of board-expansion-internal-gap rail system 134, to reinforce the unique springable hand-free-self-locking self-centering bracket-clamp fence system;

c) Can support stackable interlocking fence-board systems 141; and d) Can lock stackable-interlocking-fence-board ridge 146 therein.

Other objects and advantages of the present invention will become apparent from a consideration of the accompanying drawings and ensuing description.

SUMMARY OF THE INVENTION

Figure 1:
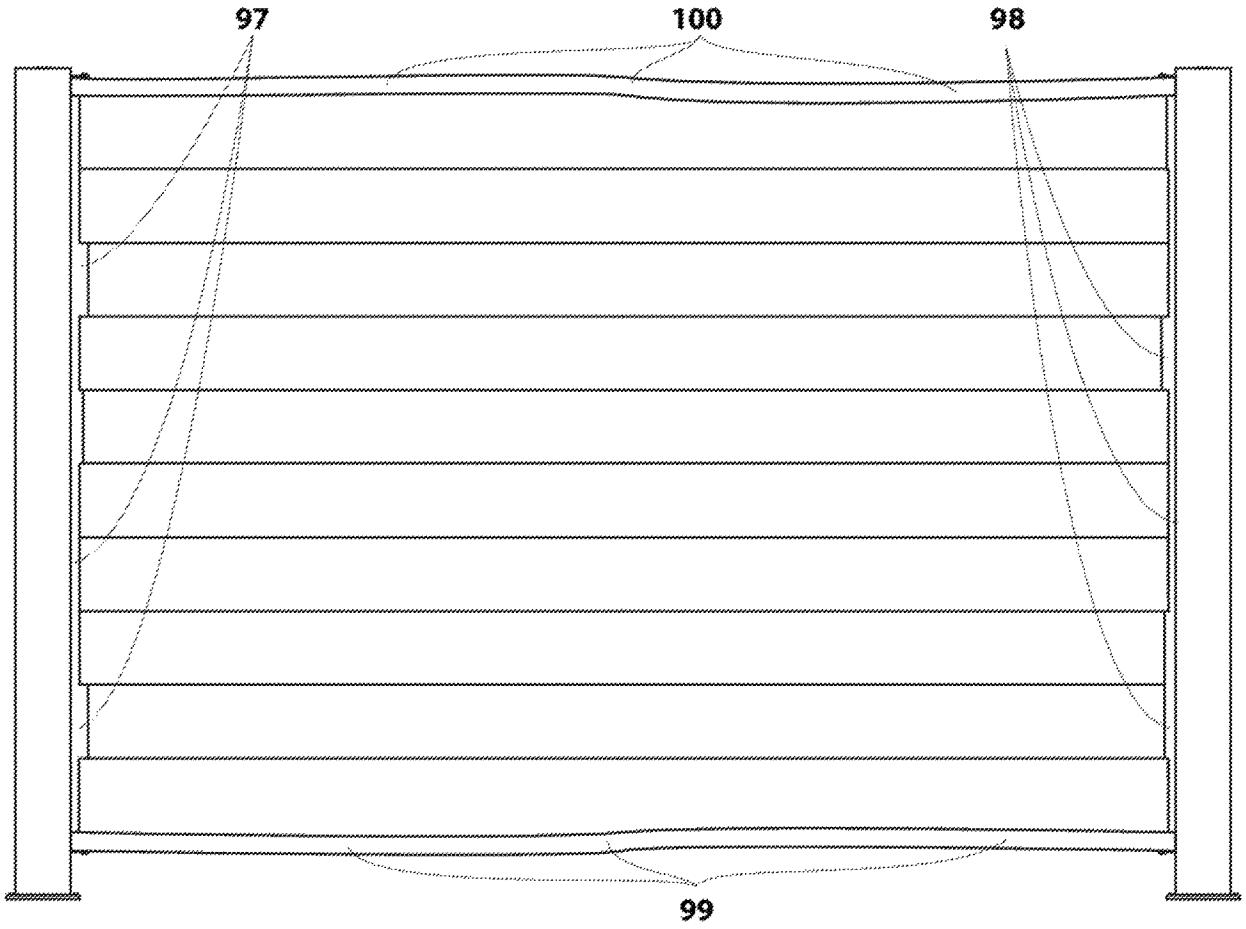
Fig. 1 (Prior Art)
FIGS. 1 (Prior Art) and 2 (Prior Art) illustrate front and top views of prior art with their disadvantages of warping, bending, and creating unwanted large splits between fence boards and fence posts (losing their capabilities of providing privacy).
Figure 2:
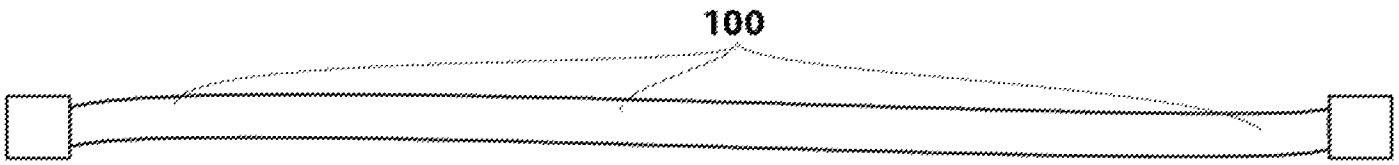
Fig. 2 (Prior Art)
Figure 3:
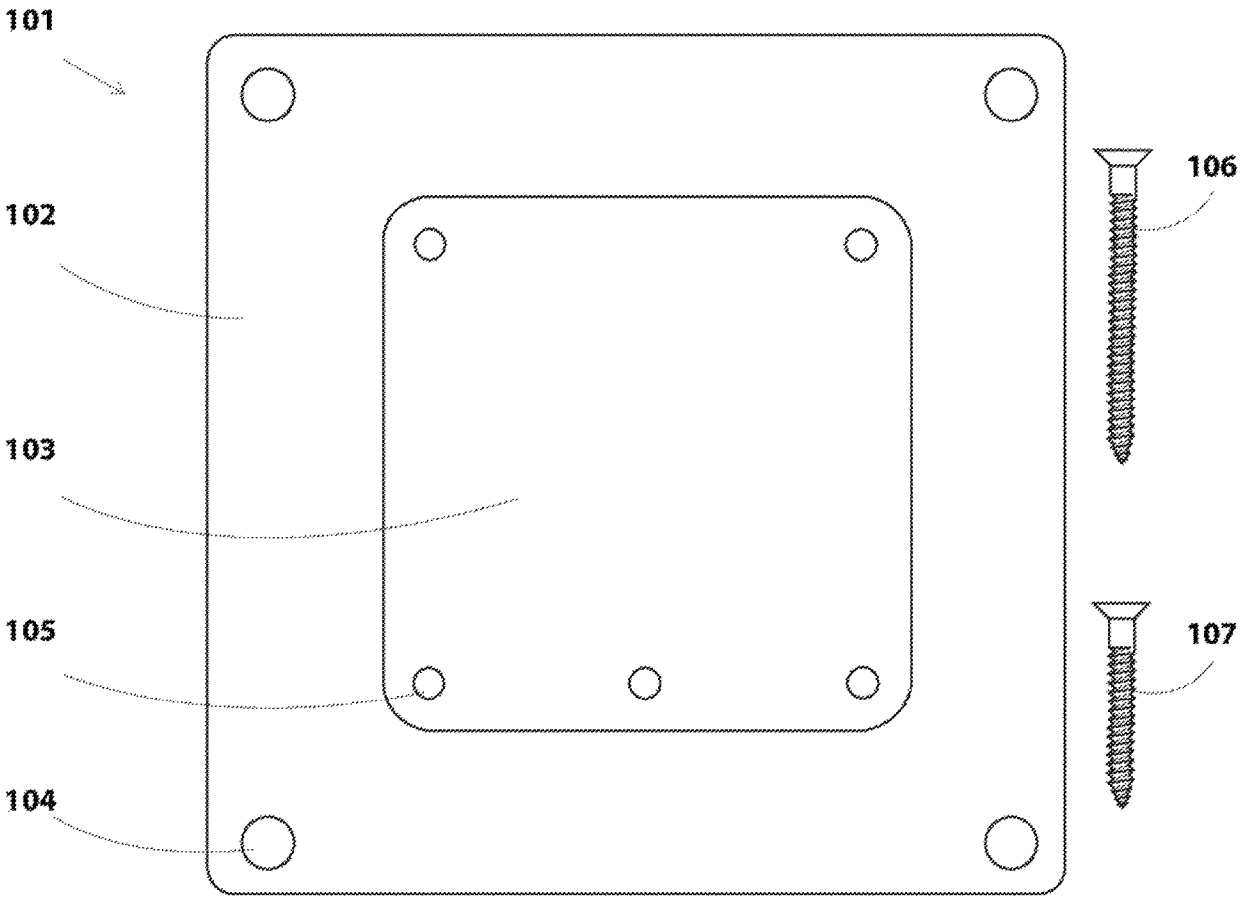
FIGS. 3, 4A, 4B, 4C, and 4D illustrate top and perspective views of the fence-post base system and the fence-post system (having a fence-post board-expansion internal gap therein) of a unique springable hand-free-self-locking self-centering bracket-clamp fence system.
Figure 4A:
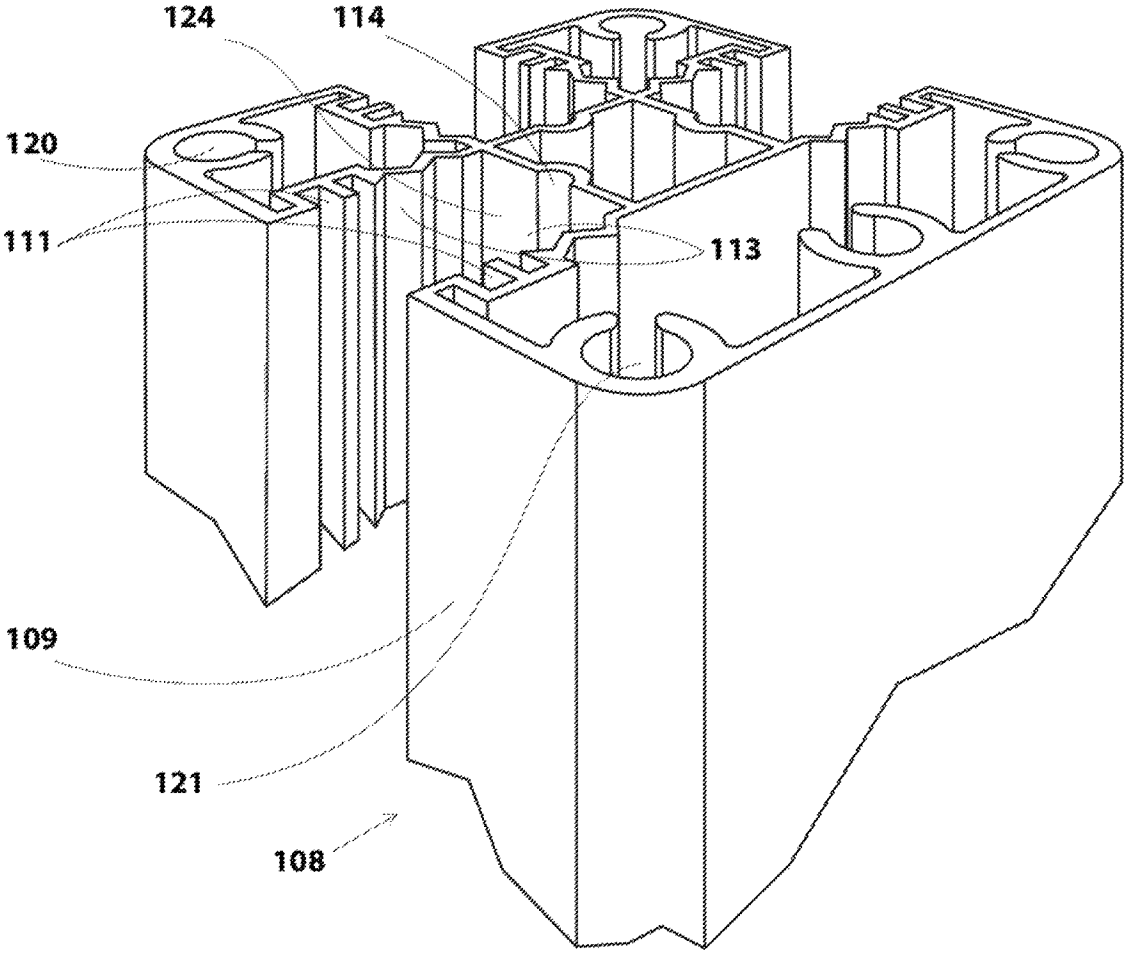
Figure 4B:
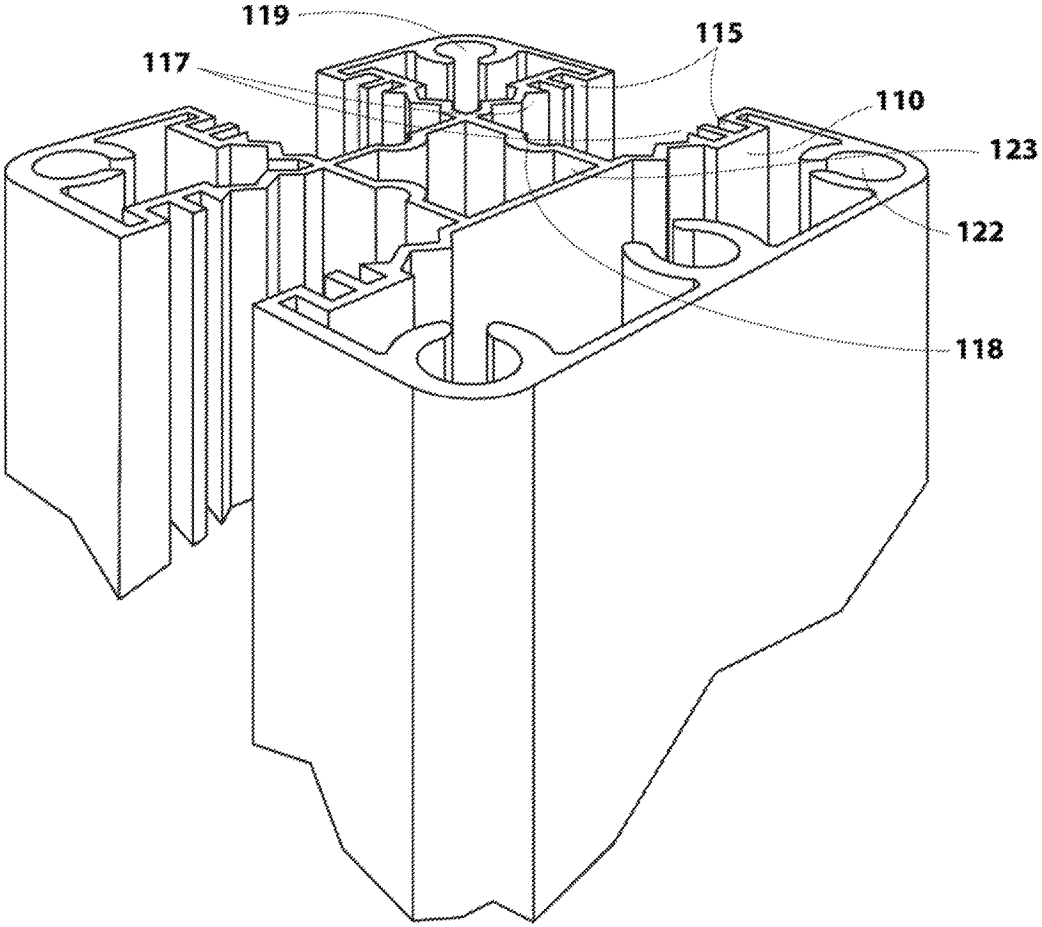
Figure 4C:
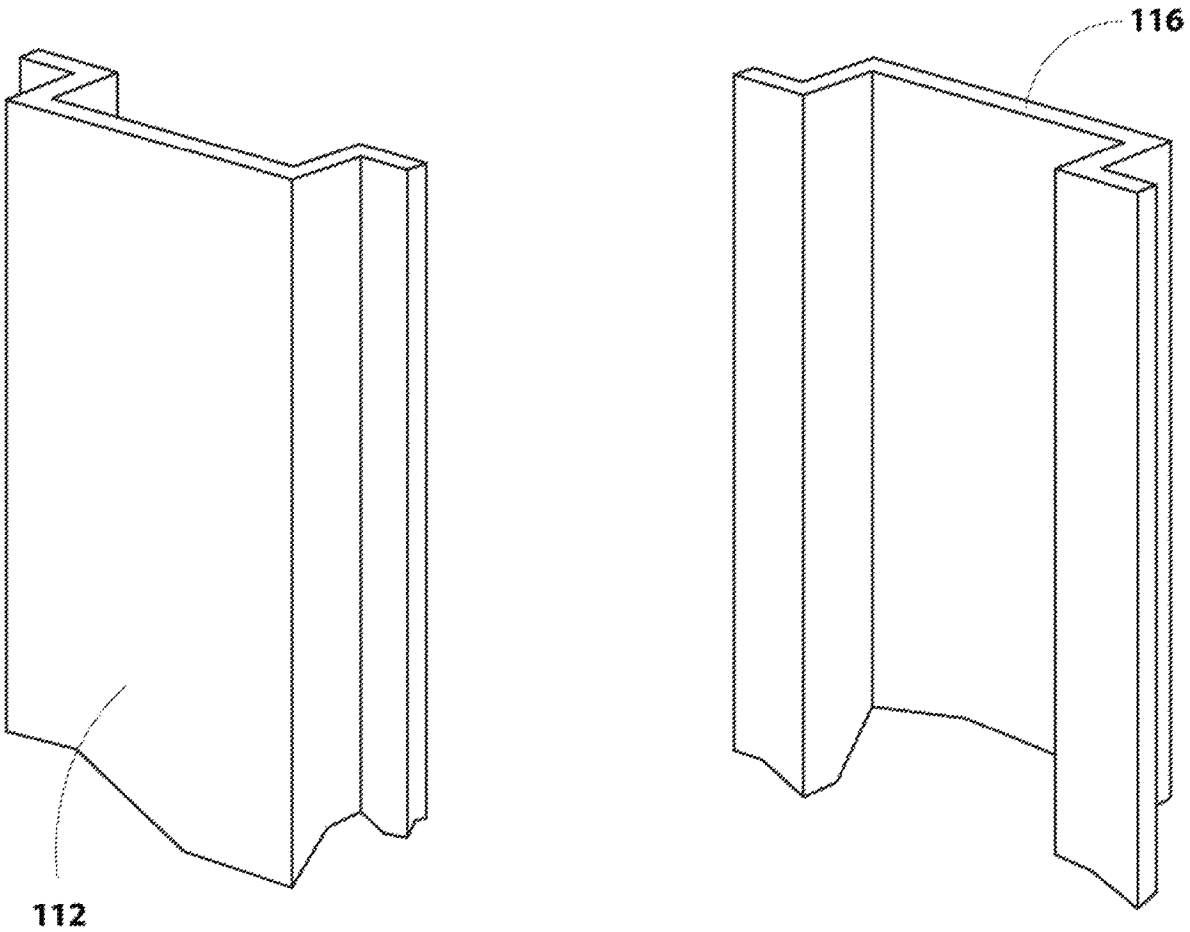
Figure 4D:
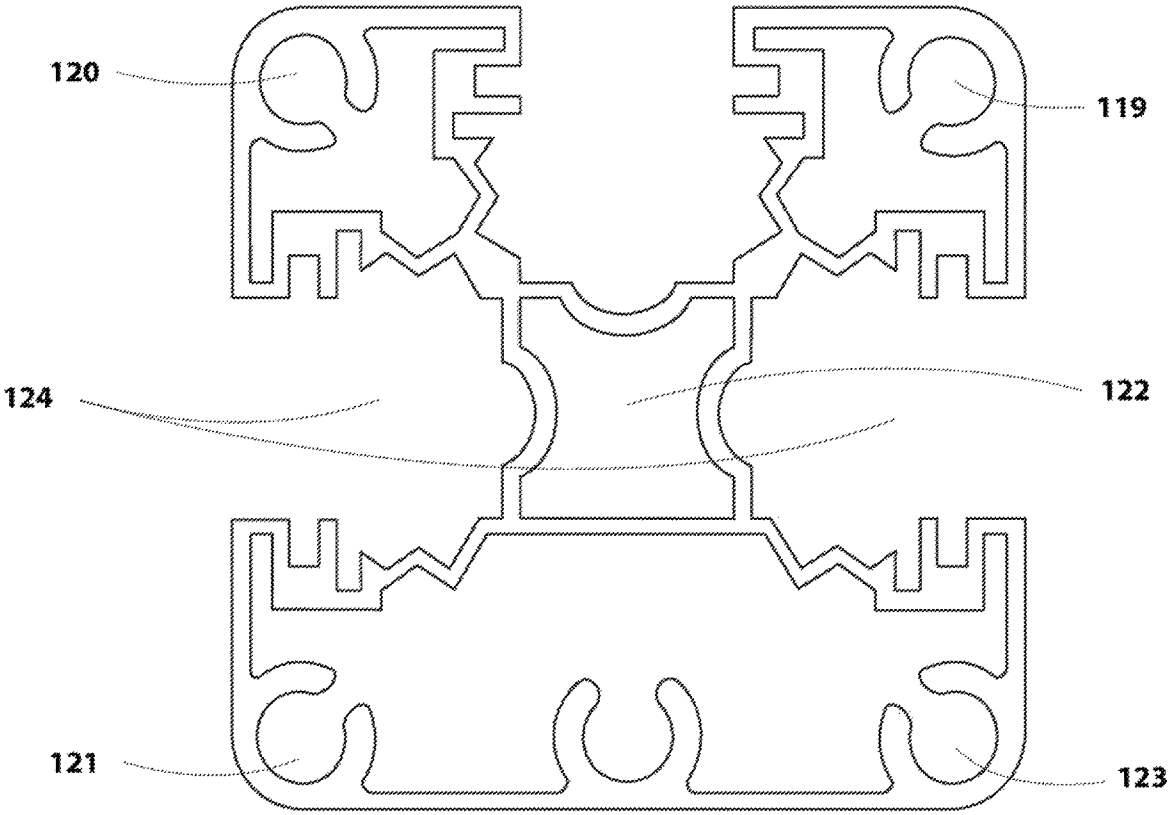
Figure 5:
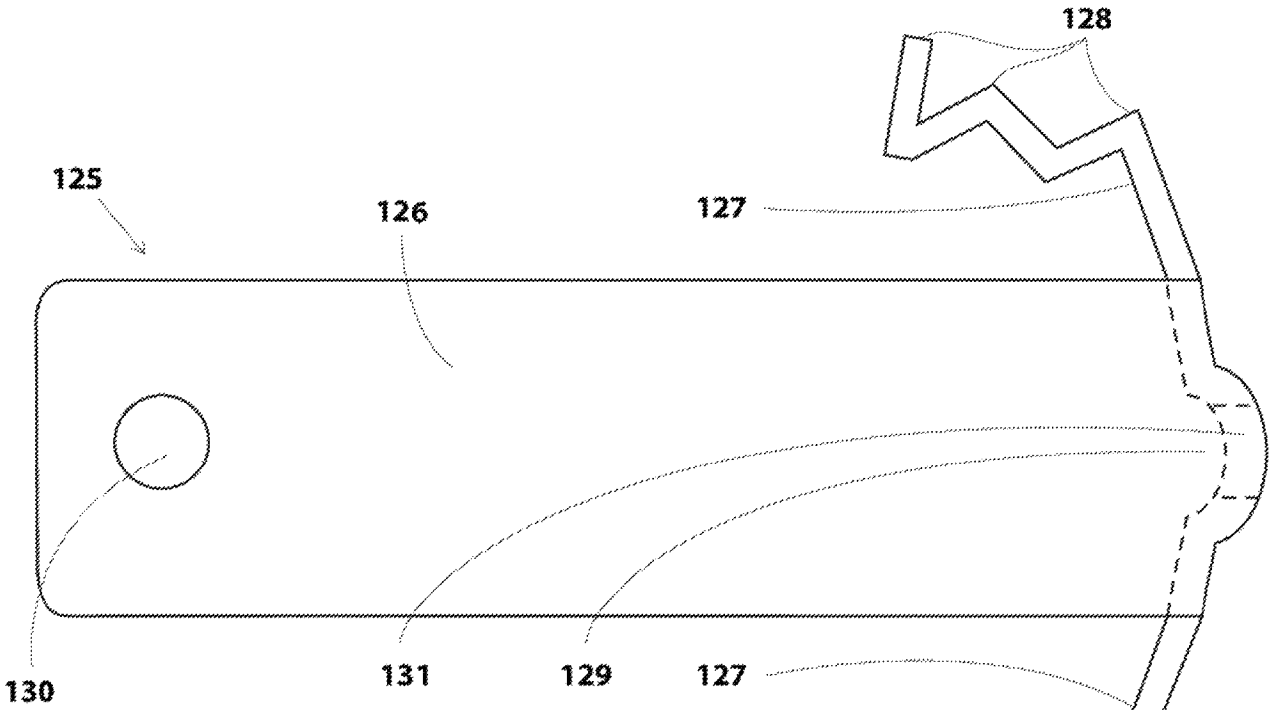
FIGS. 5, 6, and 7 illustrate top and side views of the springable hand-free-self-locking self-centering bracket-clamp system of the unique springable hand-free-self-locking self-centering bracket-clamp fence system.
Figure 6:
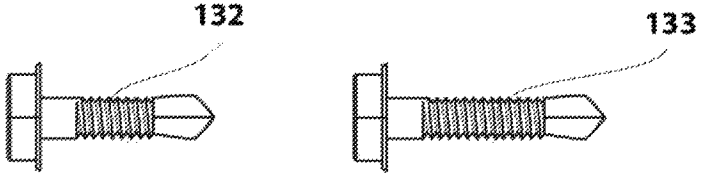
Figure 7:
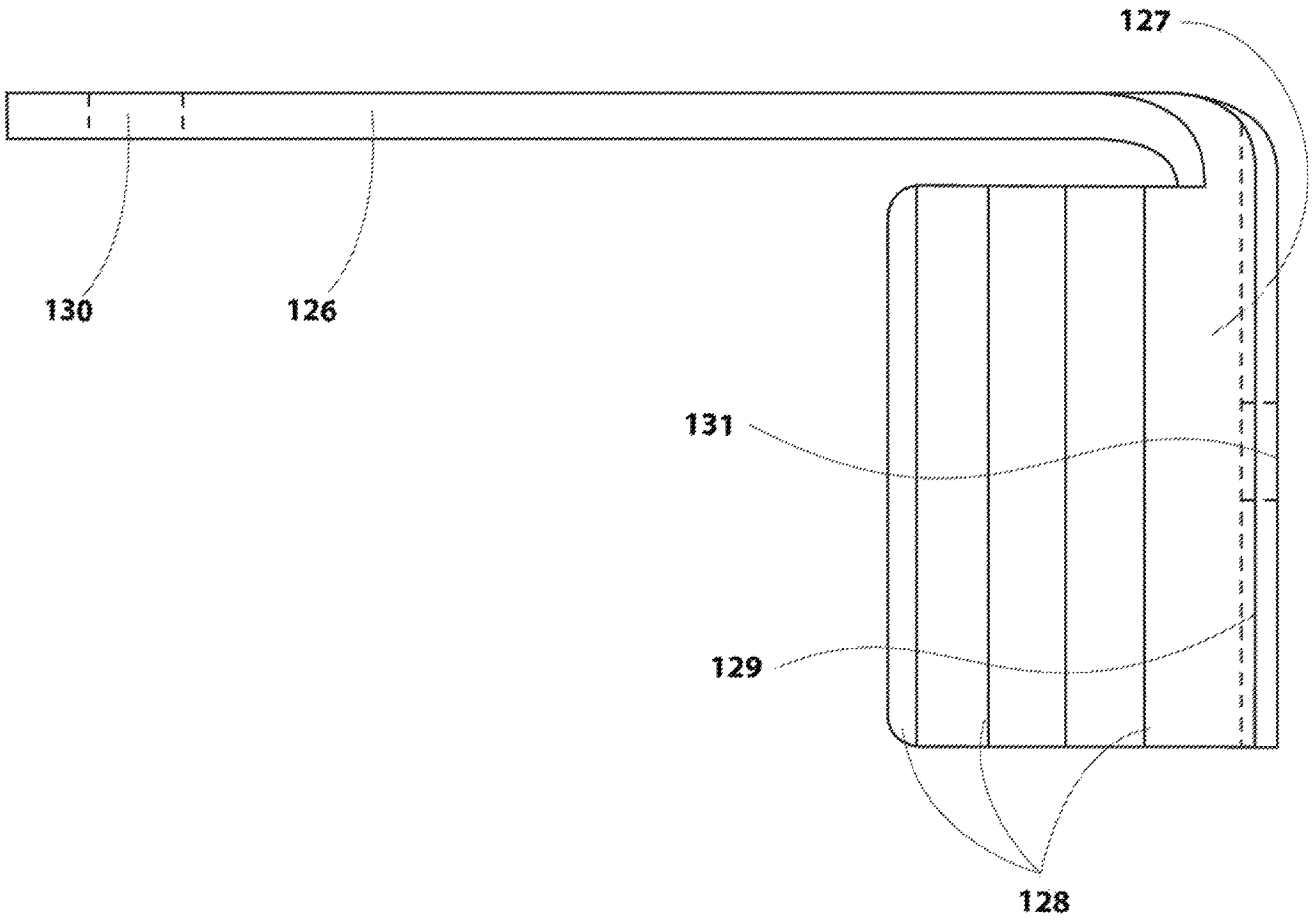
Figure 8:
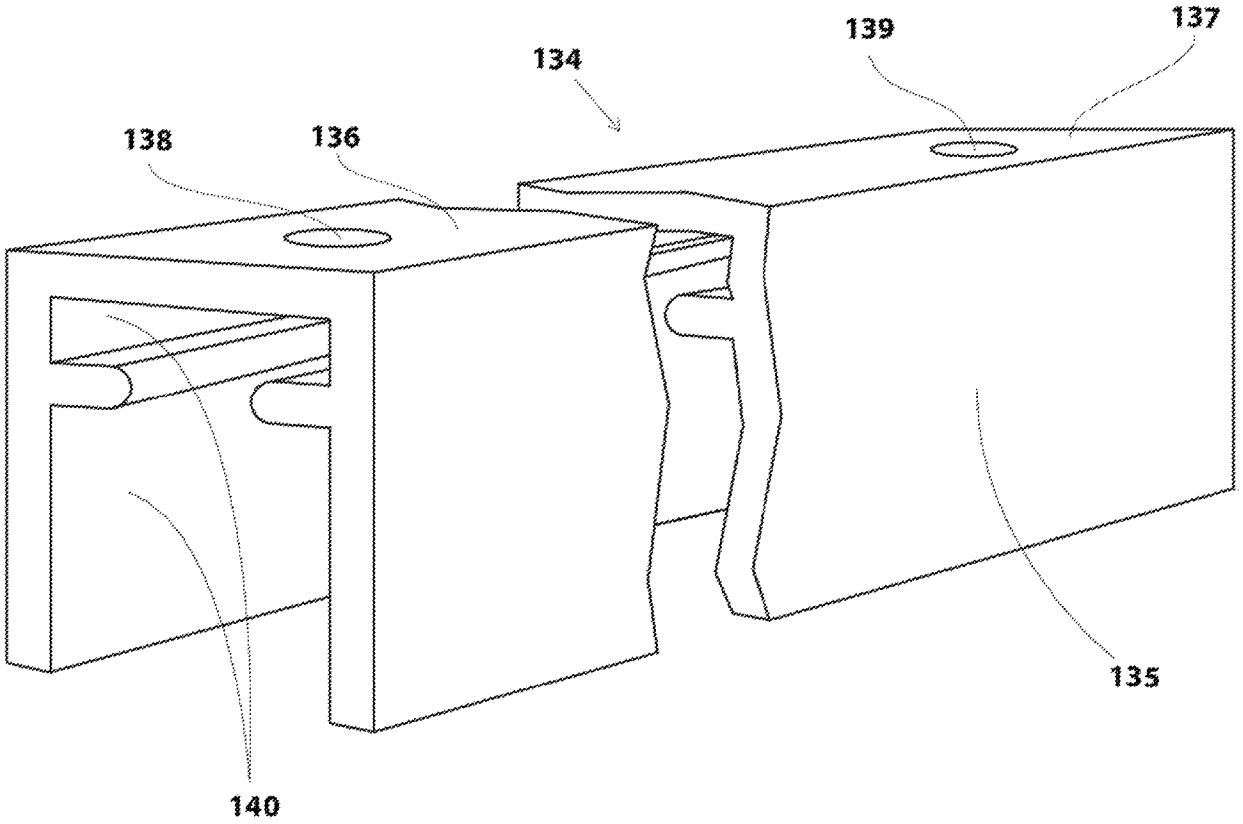
FIG. 8 illustrates a perspective view of a board-expansion-internal-gap rail system, having a U-shaped-rail board-expansion internal gap therein.
Figure 9:
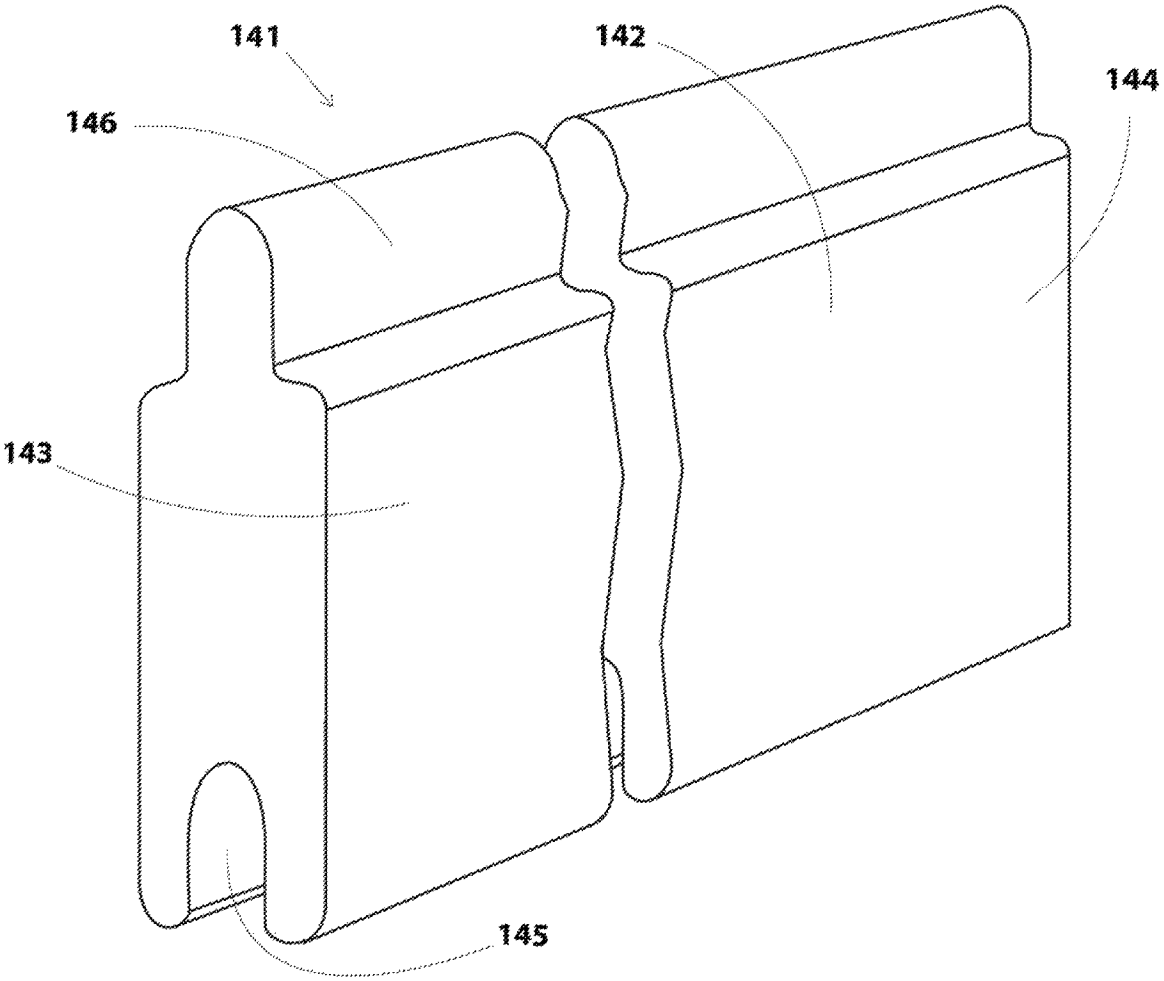
FIG. 9 illustrates a perspective view of a stackable interlocking fence-board systems, having a stackable-interlocking-fence-board slot and a stackable-interlocking-fence-board ridge thereon.
Figure 10:
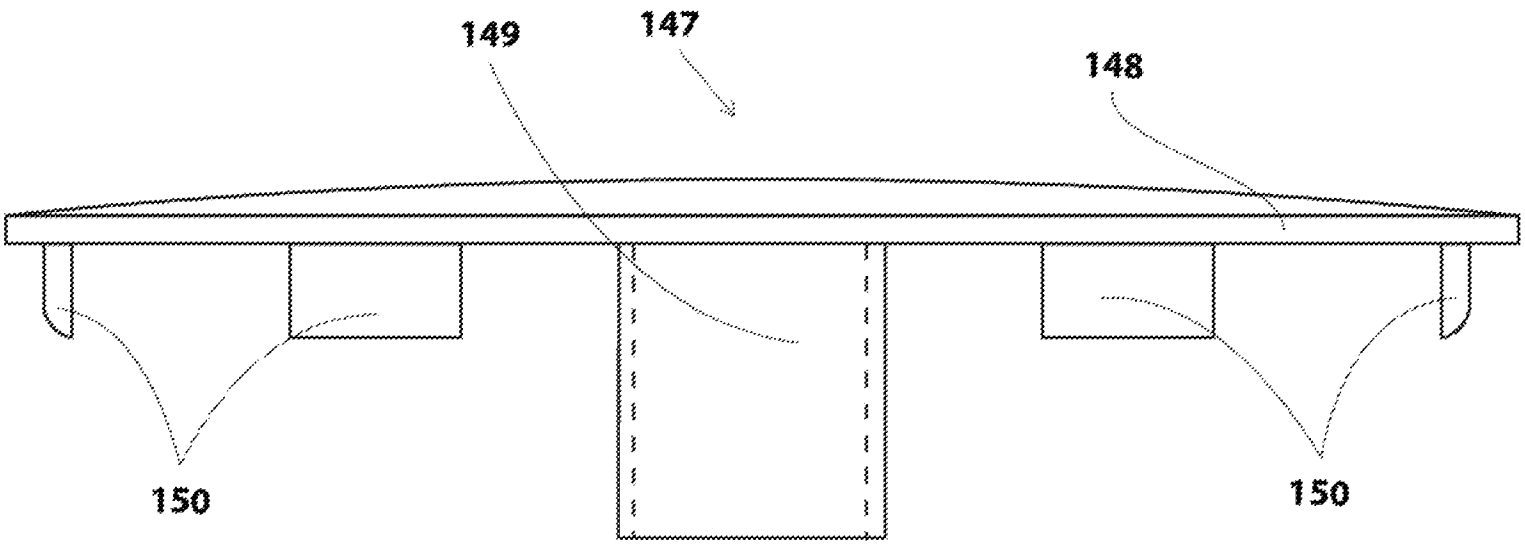
FIGS. 10 and 11 illustrate top and bottom views of the fence-post-covering cap system of the unique springable hand-free-self-locking self-centering bracket-clamp fence system.
Figure 11:
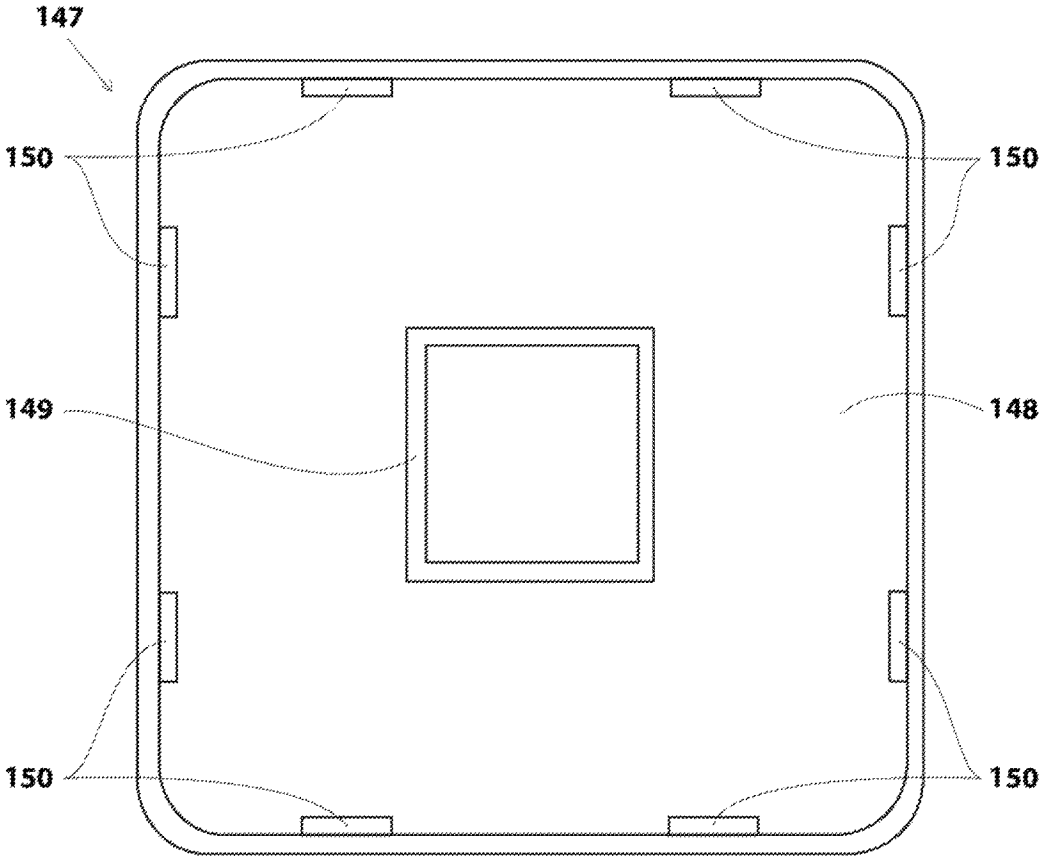

A unique springable hand-free-self-locking self-centering bracket-clamp fence system comprises fence-post base systems, fence-post systems, springable hand-free-self-locking self-centering bracket-clamp systems, board-expansion-internal-gap rail systems, stackable interlocking fence-board systems, and fence-post-covering cap systems. The fence-post base systems are for supporting the fence-post systems, respectively. The fence-post systems are for supporting the board-expansion-internal-gap rail systems, respectively. The board-expansion-internal-gap rail systems are for supporting the stackable interlocking fence-board systems, respectively. The fence-post-covering cap systems are for preventing water penetration to the inside of the fence-post systems, respectively. The fence-post systems have multiple bracket-clamp-locking jaw slots and multiple bracket-clamp-centering grooves. The springable hand-free-self-locking self-centering bracket-clamp systems have springable hand-free-self-locking self-centering bracket-clamp jaws for locking the springable hand-free-self-locking self-centering bracket-clamp systems in the multiple bracket-clamp-locking jaw slots respectively, springable hand-free-self-locking self-centering bracket-clamp teeth for biting into the multiple bracket-clamp-locking jaw slots respectively, and springable hand-free-self-locking self-centering bracket-clamp groove, for centering the springable hand-free-self-locking self-centering bracket-clamp systems in the multiple bracket-clamp-centering grooves respectively, to center the stackable interlocking fence-board systems in the fence-post systems, respectively, and to offer unique privacy.

DETAILED DESCRIPTION OF THE INVENTION

Component

A unique springable hand-free-self-locking self-centering bracket-clamp fence system has:

a) Fence-post base systems, b) Fence-post systems, c) Springable hand-free-self-locking self-centering bracket-clamp systems, d) Board-expansion-internal-gap rail systems, e) Stackable interlocking fence-board systems, and f) Fence-post-covering cap systems.

Referring to FIGS. 3, 4A, 4B, 4C, 4D, 5, 6, 7, 8, 9, 10, and 11, a unique springable hand-free-self-locking self-centering bracket-clamp fence system, having hand-free-self-locking self-centering bracket-clamp systems, board-expansion-internal-gap post systems, and board-expansion-internal-gap rail systems, comprises:

1) Fence-post base systems 101, each comprising:

2) Post-supporting base 102,

3) Post-supporting base recess 103,

4) Post-supporting base-screw holes 104,

5) Post-supporting post-screw holes 105,

6) Post-supporting base screws 106,

7) Post-supporting post screws 107;

8) Fence-post systems 108, each comprising:

9) Fence-post external walls 109,

10) Fence-post internal walls 110,

11) First cover-locking slot 111,

12) First cover-locking-slot cover 112,

13) First bracket-clamp-locking jaw slot 113,

14) First bracket-clamp-centering groove 114,

15) Second cover-locking slot 115,

16) Second cover-locking-slot cover 116,

17) Second bracket-clamp-locking jaw slot 117,

18) Second bracket-clamp-centering groove 118,

19) Post-locking shaft 119,

20) Post-locking shaft 120,

21) Post-locking shaft 121,

22) Post-locking shaft 122,

23) Cap-locking shaft 123,
24) Fence-post board-expansion internal gap 124;
25) Springable hand-free-self-locking self-centering bracket-clamp systems 125, each comprising:
26) Springable hand-free-self-locking self-centering bracket-clamp body 126,
27) Springable hand-free-self-locking self-centering bracket-clamp jaws 127,
28) Springable hand-free-self-locking self-centering bracket-clamp teeth 128,
29) Springable hand-free-self-locking self-centering bracket-clamp groove 129,
30) Springable hand-free-self-locking self-centering bracket-body hole 130,
31) Springable hand-free-self-locking self-centering bracket-clamp hole 131,
32) Springable hand-free-self-locking self-centering bracket-body screw 132,
33) Springable hand-free-self-locking self-centering bracket-clamp screw 133;
34) Board-expansion-internal-gap rail systems 134, each comprising:
35) U-shaped-rail body 135,
36) U-shaped-rail first end 136,
37) U-shaped-rail second end 137,
38) U-shaped-rail first-end hole 138,
39) U-shaped-rail second-end hole 139,
40) U-shaped-rail board-expansion internal gap 140;
41) Stackable interlocking fence-board systems 141, each comprising:
42) Stackable-interlocking-fence-board body 142,
43) Stackable-interlocking-fence-board first end 143,
44) Stackable-interlocking-fence-board second end 144,
45) Stackable-interlocking-fence-board slot 145,
46) Stackable-interlocking-fence-board ridge 146; and
47) Fence-post-covering cap systems 147, each comprising:
48) Fence-post-covering cap body 148,
49) Fence-post-covering-cap central lock 149,
50) Fence-post-covering-cap perimeter locks 150.

Material

Referring to FIGS. 3, 4A, 4B, 4C, 4D, 5, 6, 7, 8, 9, 10, and 11:

1) Fence-post base systems 101 each are made of the combined materials of its components.
2) Post-supporting base 102 is made of metallic material.
3) Post-supporting base recess 103 is made of empty space.
4) Post-supporting base-screw holes 104 each are made of empty space.
5) Post-supporting post-screw holes 105 each are made of empty space.
6) Post-supporting base screws 106 each are made of metallic material.
7) Post-supporting post screws 107 each are made of metallic material.
8) Fence-post systems 108 each are made of the combined materials of its components.
9) Fence-post external walls 109 each are made of metallic material.
10) Fence-post internal walls 110 each are made of metallic material.
11) First cover-locking slot 111 is made of empty space.
12) First cover-locking-slot cover 112 is made of metallic material.
13) First bracket-clamp-locking jaw slot 113 is made of empty space.
14) First bracket-clamp-centering groove 114 is made of empty space.
15) Second cover-locking slot 115 is made of empty space.
16) Second cover-locking-slot cover 116 is made of metallic material.
17) Second bracket-clamp-locking jaw slot 117 is made of empty space.
18) Second bracket-clamp-centering groove 118 is made of empty space.
19) Post-locking shaft 119 is made of empty space.
20) Post-locking shaft 120 is made of empty space.
21) Post-locking shaft 121 is made of empty space.
22) Post-locking shaft 122 is made of empty space.
23) Cap-locking shaft 123 is made of empty space.
24) Fence-post board-expansion internal gap 124 is made of empty space.
25) Springable hand-free-self-locking self-centering bracket-clamp systems 125 each are made of the combined materials of its components.
26) Springable hand-free-self-locking self-centering bracket-clamp body 126 is made of metallic material.
27) Springable hand-free-self-locking self-centering bracket-clamp jaws 127 each are made of metallic material.
28) Springable hand-free-self-locking self-centering bracket-clamp teeth 128 each are made of metallic material.
29) Springable hand-free-self-locking self-centering bracket-clamp groove 129 is made of empty space.
30) Springable hand-free-self-locking self-centering bracket-body hole 130 is made of empty space.
31) Springable hand-free-self-locking self-centering bracket-clamp hole 131 is made of empty space.
32) Springable hand-free-self-locking self-centering bracket-body screw 132 is made of metallic material.
33) Springable hand-free-self-locking self-centering bracket-clamp screw 133 is made of metallic material.
34) Board-expansion-internal-gap rail systems 134 each are made of the combined materials of its components.
35) U-shaped-rail body 135 is made of metallic material.
36) U-shaped-rail first end 136 is made of metallic material.
37) U-shaped-rail second end 137 is made of metallic material.
38) U-shaped-rail first-end hole 138 is made of empty space.
39) U-shaped-rail second-end hole 139 is made of empty space.
40) U-shaped-rail board-expansion internal gap 140 is made of empty space.
41) Stackable interlocking fence-board systems 141 each are made of the combined materials of its components.
42) Stackable-interlocking-fence-board body 142 is made of wooden material, vinyl material, PVC material, aluminum material, metallic material, plastic material, plastic-composite material, composite material, and/or mixed material.
43) Stackable-interlocking-fence-board first end 143 is made of wooden material, vinyl material, PVC material, aluminum material, metallic material, plastic material, plastic-composite material, composite material, and/or mixed material.
44) Stackable-interlocking-fence-board second end 144 is made of wooden material, vinyl material, PVC material, aluminum material, metallic material, plastic material, plastic-composite material, composite material, and/or mixed material.
45) Stackable-interlocking-fence-board slot 145 is made of empty space.
46) Stackable-interlocking-fence-board ridge 146 is made of wooden material, vinyl material, PVC material, aluminum material, metallic material, plastic material, plastic-composite material, composite material, and/or mixed material.

47) Fence-post-covering cap systems 147 each are made of the combined materials of its components.

48) Fence-post-covering cap body 148 is made of wooden material, vinyl material, PVC material, aluminum material, metallic material, plastic material, plastic-composite material, composite material, and/or mixed material.

49) Fence-post-covering-cap central lock 149 is made of wooden material, vinyl material, PVC material, aluminum material, metallic material, plastic material, plastic-composite material, composite material, and/or mixed material.

50) Fence-post-covering-cap perimeter locks 150 each are made of wooden material, vinyl material, PVC material, aluminum material, metallic material, metallic material, plastic material, plastic-composite material, composite material, and/or mixed material.

Shape

Referring to FIGS. 3, 4A, 4B, 4C, 4D, 5, 6, 7, 8, 9, 10, and 11:

1) Fence-post base systems 101 each have the combined shapes of its components.

2) Post-supporting base 102 has a square shape.

3) Post-supporting base recess 103 has a square shape.

4) Post-supporting base-screw holes 104 each have a round shape.

5) Post-supporting post-screw holes 105 each have a round shape.

6) Post-supporting base screws 106 each have a screw shape.

7) Post-supporting post screws 107 each have a screw shape.

8) Fence-post systems 108 each have the combined shapes of its components.

9) Fence-post external walls 109 each have a rectangular shape.

10) Fence-post internal walls 110 each have an angularly wavy shape.

11) First cover-locking slot 111 has a rectangular shape.

12) First cover-locking-slot cover 112 has a rectangular shape.

13) First bracket-clamp-locking jaw slot 113 has a zigzag shape.

14) First bracket-clamp-centering groove 114 has a half-circle shape.

15) Second cover-locking slot 115 has a rectangular shape.

16) Second cover-locking-slot cover 116 has a rectangular shape.

17) Second bracket-clamp-locking jaw slot 117 has a zigzag shape.

18) Second bracket-clamp-centering groove 118 has a half-circle shape.

19) Post-locking shaft 119 has a round-cylinder shape.

20) Post-locking shaft 120 has a round-cylinder shape.

21) Post-locking shaft 121 has a round-cylinder shape.

22) Post-locking shaft 122 has a round-cylinder shape.

23) Cap-locking shaft 123 has a grooved-square-cylinder shape.

24) Fence-post board-expansion internal gap 124 has a rectangular shape.

25) Springable hand-free-self-locking self-centering bracket-clamp systems 125 each have the combined shapes of its components.

26) Springable hand-free-self-locking self-centering bracket-clamp body 126 has a rectangular shape.

27) Springable hand-free-self-locking self-centering bracket-clamp jaws 127 each have a zigzagged shape.

28) Springable hand-free-self-locking self-centering bracket-clamp teeth 128 each have a triangular shape.

29) Springable hand-free-self-locking self-centering bracket-clamp groove 129 has a half-circle shape.

30) Springable hand-free-self-locking self-centering bracket-body hole 130 has a round shape.

31) Springable hand-free-self-locking self-centering bracket-clamp hole 131 has a round shape.

32) Springable hand-free-self-locking self-centering bracket-body screw 132 has a screw shape.

33) Springable hand-free-self-locking self-centering bracket-clamp screw 133 has a screw shape.

34) Board-expansion-internal-gap rail systems 134 each have the combined shapes of its components.

35) U-shaped-rail body 135 has an elongated u-shape.

36) U-shaped-rail first end 136 has a u-shape shape.

37) U-shaped-rail second end 137 has a u-shape shape.

38) U-shaped-rail first-end hole 138 has a round shape.

39) U-shaped-rail second-end hole 139 has a round shape.

40) U-shaped-rail board-expansion internal gap 140 has a rectangular shape.

41) Stackable interlocking fence-board systems 141 each have the combined shapes of its components.

42) Stackable-interlocking-fence-board body 142 has a rectangular shape.

43) Stackable-interlocking-fence-board first end 143 has a square shape.

44) Stackable-interlocking-fence-board second end 144 has a shape.

45) Stackable-interlocking-fence-board slot 145 has a rectangular shape.

46) Stackable-interlocking-fence-board ridge 146 has a rectangular shape.

47) Fence-post-covering cap systems 147 each have the combined shapes of its components.

48) Fence-post-covering cap body 148 has a square shape.

49) Fence-post-covering-cap central lock 149 has a square-tube shape.

50) Fence-post-covering-cap perimeter locks 150 each have a square shape.

Connection

Referring to FIGS. 3, 4A, 4B, 4C, 4D, 5, 6, 7, 8, 9, 10, and 11:

1) Fence-post base systems 101 each are screwed to one fence-post system 108 and to a foundation or patio.

2) Post-supporting base 102 is screwed to one fence-post system 108 and to a foundation or patio.

3) Post-supporting base recess 103 is molded in post-supporting base 102.

4) Post-supporting base-screw holes 104 each are molded in post-supporting base 102.

5) Post-supporting post-screw holes 105 each are molded in post-supporting base recess 103.

6) Post-supporting base screws 106 each are screwed through post-supporting base-screw holes 104.

7) Post-supporting post screws 107 each are screwed through post-supporting post-screw holes 105.

8) Fence-post systems 108 each are screwed to one fence-post base system 101.

9) Fence-post external walls 109 each are molded to at least one other fence-post external wall 109 and at least one fence-post internal wall 110.

10) Fence-post internal walls 110 each are molded to at least one other fence-post internal wall 110 and at least one fence-post external wall 109.

11) First cover-locking slot 111 is molded into at least one fence-post internal wall 110.

12) First cover-locking-slot cover 112 is slid onto one first cover-locking slot 111.
13) First bracket-clamp-locking jaw slot 113 is molded into at least one fence-post internal wall 110.
14) First bracket-clamp-centering groove 114 is molded into one fence-post internal wall 110.
15) Second cover-locking slot 115 is molded into at least one fence-post internal wall 110.
16) Second cover-locking-slot cover 116 is slid onto one first cover-locking slot 111.
17) Second bracket-clamp-locking jaw slot 117 is molded into at least one fence-post internal wall 110.
18) Second bracket-clamp-centering groove 118 is molded into one fence-post internal wall 110.
19) Post-locking shaft 119 is molded to at least one fence-post external walls 109.
20) Post-locking shaft 120 is molded to at least one fence-post external walls 109.
21) Post-locking shaft 121 is molded to at least one fence-post external walls 109.
22) Post-locking shaft 122 is molded to at least one fence-post external walls 109.
23) Cap-locking shaft 123 is molded along the central axis of fence-post system 108.
24) Fence-post board-expansion internal gap 124 is molded between at least one fence-post internal wall 110.
25) Springable hand-free-self-locking self-centering bracket-clamp systems 125 each are screwed to one fence-post system 108 and to one u-shaped rail first end 136 or one u-shaped rail second end 137.
26) Springable hand-free-self-locking self-centering bracket-clamp body 126 is molded to springable hand-free-self-locking self-centering bracket-clamp jaw 127.
27) Springable hand-free-self-locking self-centering bracket-clamp jaws 127 each are molded to Springable hand-free-self-locking self-centering bracket-clamp body 126.
28) Springable hand-free-self-locking self-centering bracket-clamp teeth 128 each are molded to one springable hand-free-self-locking self-centering bracket-clamp jaw 127.
29) Springable hand-free-self-locking self-centering bracket-clamp groove 129 is molded to springable hand-free-self-locking self-centering bracket-clamp jaw 127.
30) Springable hand-free-self-locking self-centering bracket-body hole 130 is drilled into springable hand-free-self-locking self-centering bracket-clamp body 126.
31) Springable hand-free-self-locking self-centering bracket-clamp hole 131 is drilled into springable hand-free-self-locking self-centering bracket-clamp groove 129.
32) Springable hand-free-self-locking self-centering bracket-body screw 132 is screwed through springable hand-free-self-locking self-centering bracket-body hole 130.
33) Springable hand-free-self-locking self-centering bracket-clamp screw 133 is screwed through springable hand-free-self-locking self-centering bracket-clamp hole 131.
34) Board-expansion-internal-gap rail systems 134 each are screwed to one springable hand-free-self-locking self-centering bracket-clamp system 125.
35) U-shaped-rail body 135 each are screwed to one springable hand-free-self-locking self-centering bracket-clamp system 125.
36) U-shaped-rail first end 136 is molded to u-shaped-rail body 135.
37) U-shaped-rail second end 137 is molded to u-shaped-rail body 135.
38) U-shaped-rail first-end hole 138 is drilled into u-shaped-rail first end 136.
39) U-shaped-rail second-end hole 139 is drilled into u-shaped-rail second end 137.
40) U-shaped-rail board-expansion internal gap 140 is formed inside and along U-shaped-rail body 135.
41) Stackable interlocking fence-board systems 141 each are slid between one board-expansion-internal-gap rail system 134 and/or at least one other stackable interlocking fence-board systems 141.
42) Stackable-interlocking-fence-board body 142 is molded to stackable-interlocking-fence-board first end 143 and stackable-interlocking-fence-board second end 144.
43) Stackable-interlocking-fence-board first end 143 is molded to stackable-interlocking-fence-board body 142.
44) Stackable-interlocking-fence-board second end 144 is molded to stackable-interlocking-fence-board body 142.
45) Stackable-interlocking-fence-board slot 145 is molded into and along the bottom of stackable-interlocking-fence-board body 142.
46) Stackable-interlocking-fence-board ridge 146 is molded into and along the top of stackable-interlocking-fence-board body 142.
47) Fence-post-covering cap systems 147 each are press-locked on the top of one fence-post system 108.
48) Fence-post-covering cap body 148 is molded to fence-post-covering-cap central lock 149 and to fence-post-covering-cap perimeter locks 150.
49) Fence-post-covering-cap central lock 149 is molded to undersurface and along the central axis of fence-post-covering cap body 148.
50) Fence-post-covering-cap perimeter locks 150 each are molded to the undersurface and along the perimeter of fence-post-covering cap body 148.

Function

Referring to FIGS. 3, 4A, 4B, 4C, 4D, 5, 6, 7, 8, 9, 10, and 11:

1) Fence-post base systems 101 each are for:
   a) Supporting one fence-post system 108;
   b) Securing one fence-post system 108 to and to a foundation or patio.
2) Post-supporting base 102 is for:
   a) Supporting one fence-post system 108; and
   b) Securing one fence-post system 108 to and to a foundation or patio.
3) Post-supporting base recess 103 is for sitting fence-post system 108 therein.
4) Post-supporting base-screw holes 104 each are for screwing one post-supporting base screw 106 therethrough.
5) Post-supporting post-screw holes 105 each are for screwing one post-supporting post screw 107 therethrough.
6) Post-supporting base screws 106 each are for screwing through one post-supporting base-screw hole 104 into a foundation or deck.
7) Post-supporting post screws 107 each are for screwing through one post-supporting post-screw hole 105 into one fence-post system 108.
8) Fence-post systems 108 each are for:
   a) Centering springable hand-free-self-locking self-centering bracket-clamp systems 125;
   b) Centering board-expansion-internal-gap rail systems 134;
   c) Centering stackable interlocking fence-board systems 141;

d) Supporting and securing springable hand-free-self-locking self-centering bracket-clamp systems 125;

e) Supporting and securing board-expansion-internal-gap rail systems 134;

f) Supporting and securing stackable interlocking fence-board systems 141 g) Accommodating expansion and contraction of stackable interlocking fence-board systems 141 inside fence-post board-expansion internal gap 124 of fence-post system 108, to prevent stackable interlocking fence-board systems 141 from warping, bending, and breaking; and h) Allowing deep insertion of stackable interlocking fence-board systems 141 into fence-post board-expansion internal gap 124 of fence-post system 108, to eliminate the empty space (created when stackable interlocking fence-board systems 141 contract under cold weather) between stackable interlocking fence-board systems 141 and fence-post system 108 to provide seamless barriers for privacy and to reinforce the unique springable hand-free-self-locking self-centering bracket-clamp fence system.

9) Fence-post external walls 109 each are for supporting at least one fence-post internal wall 110.

10) Fence-post internal walls 110 each are for supporting at least one fence-post external wall 109.

11) First cover-locking slot 111 is for sliding and locking first cover-locking-slot cover 112 therein.

12) First cover-locking-slot cover 112 is for covering first cover-locking slot 111.

13) First bracket-clamp-locking jaw slot 113 is for:

a) Squeezing springable hand-free-self-locking self-centering bracket-clamp jaws 127 therein; and b) Locking springable hand-free-self-locking self-centering bracket-clamp jaws 127 therein.

14) First bracket-clamp-centering groove 114 is for:

a) Centering springable hand-free-self-locking self-centering bracket-clamp groove 129 therein;

b) Centering springable hand-free-self-locking self-centering bracket-clamp teeth 128 therein;

c) Centering springable hand-free-self-locking self-centering bracket-clamp jaws 127 therein;

d) Centering springable hand-free-self-locking self-centering bracket-clamp body 126 therein;

e) Centering springable hand-free-self-locking self-centering bracket-clamp system 125 therein;

f) Centering board-expansion-internal-gap rail systems 134; and g) Centering stackable interlocking fence-board systems 141.

15) Second cover-locking slot 115 is for sliding and locking second cover-locking-slot cover 116 therein.

16) Second cover-locking-slot cover 116 is for covering second cover-locking slot 115.

17) Second bracket-clamp-locking jaw slot 117 is for:

a) Squeezing springable hand-free-self-locking self-centering bracket-clamp jaws 127 therein; and b) Locking springable hand-free-self-locking self-centering bracket-clamp jaws 127 therein.

18) Second bracket-clamp-centering groove 118 is for:

e) Centering springable hand-free-self-locking self-centering bracket-clamp groove 129 therein;

f) Centering springable hand-free-self-locking self-centering bracket-clamp teeth 128 therein;

g) Centering springable hand-free-self-locking self-centering bracket-clamp jaws 127 therein;

h) Centering springable hand-free-self-locking self-centering bracket-clamp body 126 therein;

i) Centering springable hand-free-self-locking self-centering bracket-clamp system 125 therein;

j) Centering board-expansion-internal-gap rail systems 134; and k) Centering stackable interlocking fence-board systems 141.

19) Post-locking shaft 119 is for screwing post-supporting post screw 107 therein.

20) Post-locking shaft 120 is for screwing post-supporting post screw 107 therein.

21) Post-locking shaft 121 is for screwing post-supporting post screw 107 therein.

22) Post-locking shaft 122 is for screwing post-supporting post screw 107 therein.

23) Cap-locking shaft 123 is for press-locking fence-post-covering-cap central lock 149 therein.

24) Fence-post board-expansion internal gap 124 is for:

a) Accommodating expansion and contraction of stackable interlocking fence-board systems 141 inside fence-post board-expansion internal gap 124 of fence-post system 108, to prevent stackable interlocking fence-board systems 141 from warping, bending, and breaking; and b) Allowing deep insertion of stackable interlocking fence-board systems 141 into fence-post board-expansion internal gap 124 of fence-post system 108, to eliminate the empty space (created when stackable interlocking fence-board systems 141 contract under cold weather) between stackable interlocking fence-board systems 141 and fence-post system 108 to provide seamless barriers for privacy and to reinforce the unique springable hand-free-self-locking self-centering bracket-clamp fence system.

25) Springable hand-free-self-locking self-centering bracket-clamp systems 125 each are for:

a) Springably and temporarily securing springable hand-free-self-locking self-centering bracket-clamp system 125 in place, to eliminate the need for manually holding it while screwing it to fence-post system 108, and therefore, to eliminate personal injuries;

b) Reducing fence-installing time, by eliminating the need for manually holding springable hand-free-self-locking self-centering bracket-clamp system 125 while installing the unique springable hand-free-self-locking self-centering bracket-clamp fence system;

c) Springably locking springable hand-free-self-locking self-centering bracket-clamp screw 133 to fence-post system 108, by functioning as a springably locking washer d) Centering board-expansion-internal-gap rail system 134 inside fence-post board-expansion internal gap 124;

e) Centering stackable interlocking fence-board system 141 inside fence-post board-expansion internal gap 124;

f) Securing board-expansion-internal-gap rail system 134 to fence-post system 108; and g) Securing stackable interlocking fence-board system 141 to fence-post system 108.

26) Springable hand-free-self-locking self-centering bracket-clamp body 126 is for attaching board-expansion-internal-gap rail systems 134 to springable hand-free-self-locking self-centering bracket-clamp jaws 127.

27) Springable hand-free-self-locking self-centering bracket-clamp jaws 127 each are for:

l) Being squeezed into jaw slot 113, 117, or 121;

m) Springably and temporarily securing springable hand-free-self-locking self-centering bracket-clamp system 125 in place, to eliminate the need for holding it while screwing it to fence-post system 108;

n) Reducing fence-installing time, by eliminating the need for manually holding springable hand-free-self-locking self-centering bracket-clamp system 125 while installing the unique hand-free-springable self-locking self-centering bracket-clamp fence system; and o) Functioning as a springably locking washer to springably lock springable hand-free-self-locking self-centering bracket-clamp screw 133 to fence-post system 108.

28) Springable hand-free-self-locking self-centering bracket-clamp teeth 128 each are for biting into jaw slot 113, 117, or 121.

29) Springable hand-free-self-locking self-centering bracket-clamp groove 129 is for:

p) Sliding in bracket-clamp-centering groove 114, 118, or 122;

q) Centering springable hand-free-self-locking self-centering bracket-clamp teeth 128 therein;

r) Centering springable hand-free-self-locking self-centering bracket-clamp jaws 127 therein;

s) Centering springable hand-free-self-locking self-centering bracket-clamp body 126 therein; and t) Centering springable hand-free-self-locking self-centering bracket-clamp system 125 therein.

30) Springable hand-free-self-locking self-centering bracket-body hole 130 is for screwing springable hand-free-self-locking self-centering bracket-body screw 132 therethrough.

31) Springable hand-free-self-locking self-centering bracket-clamp hole 131 is for screwing springable hand-free-self-locking self-centering bracket-clamp screw 133 therethrough.

32) Springable hand-free-self-locking self-centering bracket-body screw 132 is for screwing through springable hand-free-self-locking self-centering bracket-body hole 130 and U-shaped-rail first-end hole 138 or U-shaped-rail second-end hole 139, to secure springable hand-free-self-locking self-centering bracket-clamp system 125 to board-expansion-internal-gap rail system 134.

33) Springable hand-free-self-locking self-centering bracket-clamp screw 133 is for screwing through springable hand-free-self-locking self-centering bracket-clamp hole 131 into fence-post system 108, to secure springable hand-free-self-locking self-centering bracket-clamp system 125 to fence-post system 108.

34) Board-expansion-internal-gap rail systems 134 each are for:

a) Accommodating expansion and contraction of stackable interlocking fence-board systems 141 inside U-shaped-rail board-expansion internal gap 140 of board-expansion-internal-gap rail system 134, to prevent stackable interlocking fence-board systems 141 from warping, bending, and breaking;

b) Allowing deep insertion of stackable interlocking fence-board systems 141 into U-shaped-rail board-expansion internal gap 140 of board-expansion-internal-gap rail system 134, to reinforce the unique springable hand-free-self-locking self-centering bracket-clamp fence system; and c) Supporting stackable interlocking fence-board systems 141.

35) U-shaped-rail body 135 is for supporting stackable interlocking fence-board systems 141.

36) U-shaped-rail first end 136 is for inserting into fence-post board-expansion internal gap 124.

37) U-shaped-rail second end 137 is for inserting into fence-post board-expansion internal gap 124.

38) U-shaped-rail first-end hole 138 is for screwing springable hand-free-self-locking self-centering bracket-body screw 132 therethrough, to attach u-shaped-rail body 135 to springable hand-free-self-locking self-centering bracket-clamp body 126.

39) U-shaped-rail second-end hole 139 is for screwing springable hand-free-self-locking self-centering bracket-body screw 132 therethrough, to attach u-shaped-rail body 135 to springable hand-free-self-locking self-centering bracket-clamp body 126.

40) U-shaped-rail board-expansion internal gap 140 is for:

u) Accommodating expansion and contraction of stackable interlocking fence-board systems 141 inside U-shaped-rail board-expansion internal gap 140 of board-expansion-internal-gap rail system 134, to prevent stackable interlocking fence-board systems 141 from warping, bending, and breaking;

v) Allowing deep insertion of stackable interlocking fence-board systems 141 into U-shaped-rail board-expansion internal gap 140 of board-expansion-internal-gap rail system 134, to reinforce the unique springable hand-free-self-locking self-centering bracket-clamp fence system;

w) Supporting stackable interlocking fence-board systems 141; and x) Locking stackable-interlocking-fence-board ridge 146 therein.

41) Stackable interlocking fence-board systems 141 each are for:

a) Creating a barrier; and b) Providing privacy.

42) Stackable-interlocking-fence-board body 142 is for creating a barrier and for providing privacy.

43) Stackable-interlocking-fence-board first end 143 is for sliding into fence-post board-expansion internal gap 124.

44) Stackable-interlocking-fence-board second end 144 is for sliding into fence-post board-expansion internal gap 124.

45) Stackable-interlocking-fence-board slot 145 is for stacking on and locking on stackable-interlocking-fence-board ridge 146 of one stackable interlocking fence-board system 141 thereunder.

46) Stackable-interlocking-fence-board ridge 146 is for stacking under and locking in stackable-interlocking-fence-board slot 145 of one stackable interlocking fence-board system 141 thereabove.

47) Fence-post-covering cap systems 147 each are for covering the top of one fence-post system 108:

a) To prevent water penetration to the inside of fence-post systems 108;

b) To create a finished appearance thereof, to cover sharp edges thereof; and c) To prevent personal injuries.

48) Fence-post-covering cap body 148 is for covering the top of fence-post system 108, to prevent water penetration to the inside of fence-post system 108, to create a finished appearance thereof, to cover sharp edges thereof, and to prevent personal injuries.

49) Fence-post-covering-cap central lock 149 is for press-locking in cap-locking shaft 123*a*, to secure fence-post-covering cap body 148 on the top of fence-post system 108.

50) Fence-post-covering-cap perimeter locks 150 each are for press-locking in the top of fence-post system 108, to secure fence-post-covering cap body 148 on the top of fence-post system 108.

Operation

Referring to FIGS. 12A, 12B, 13, 14, 15, 16A, 16B, 17, 18, 19, and 20, the operation of the unique springable hand-free-self-locking self-centering bracket-clamp fence system, having hand-free-self-locking self-centering bracket-clamp systems, board-expansion-internal-gap post systems, and board-expansion-internal-gap rail systems, comprises:

Assembly of Base to Post and to Foundation

Figure 12A:
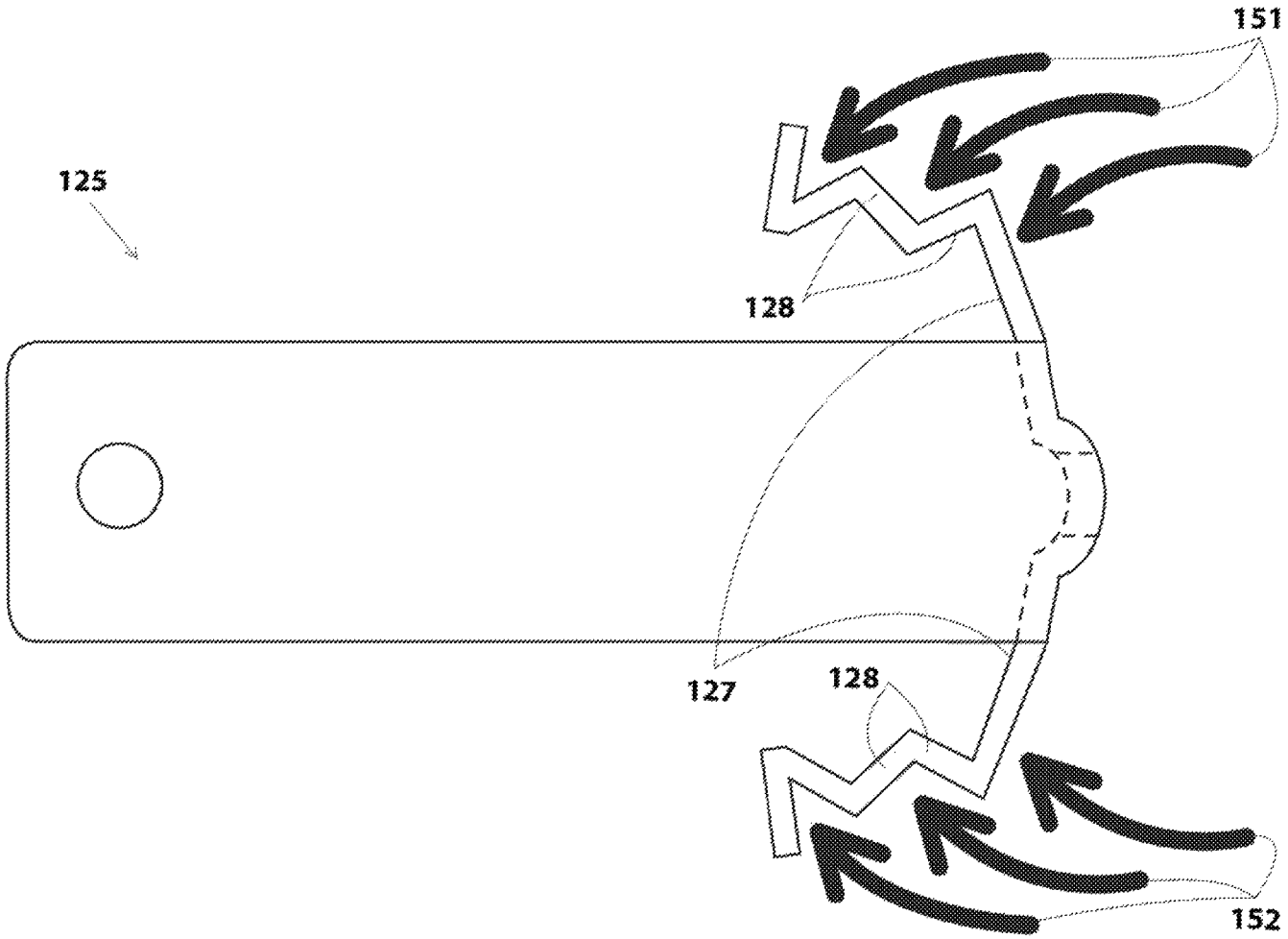
FIGS. 12A, 12B, 13, 14, 15A, and 15B illustrate side and top views of how to assemble, lock with springing force, and secure the springable hand-free-self-locking self-centering bracket-clamp system to the fence-post system.
Figure 12B:
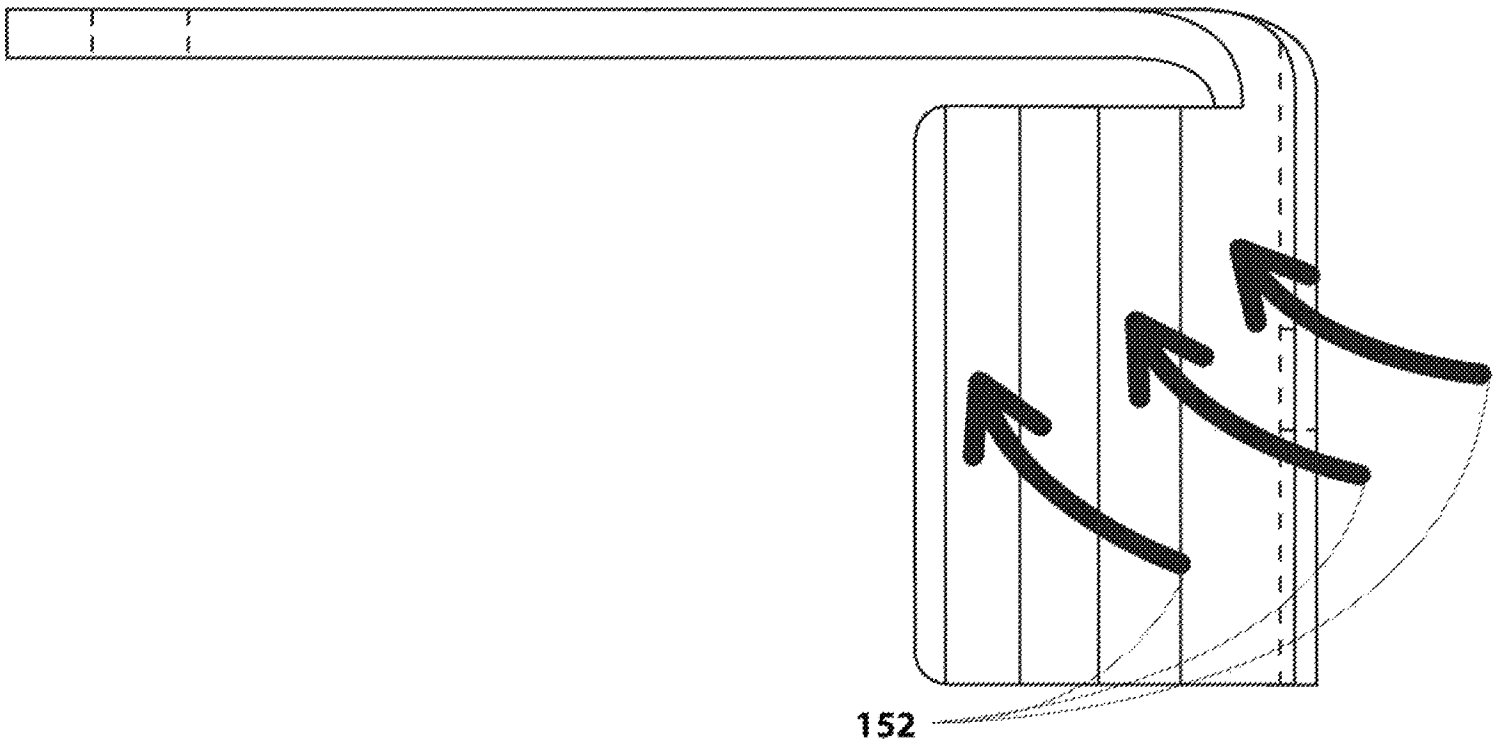
Figure 13:
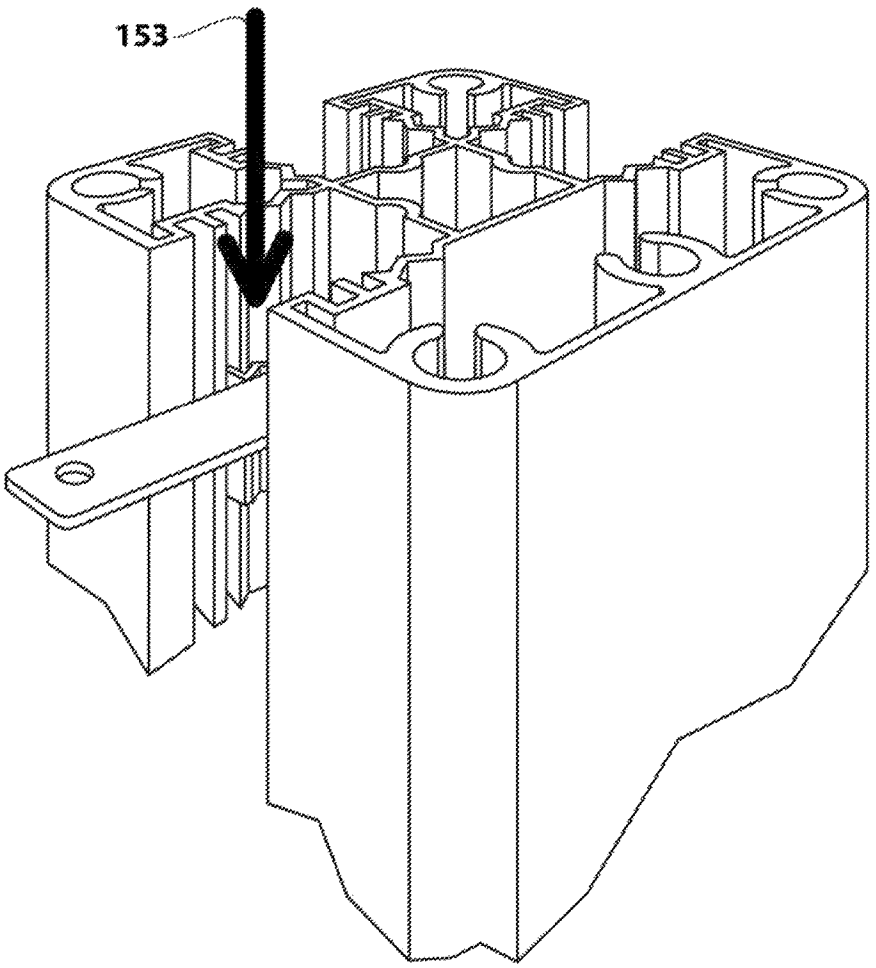
Figure 14:
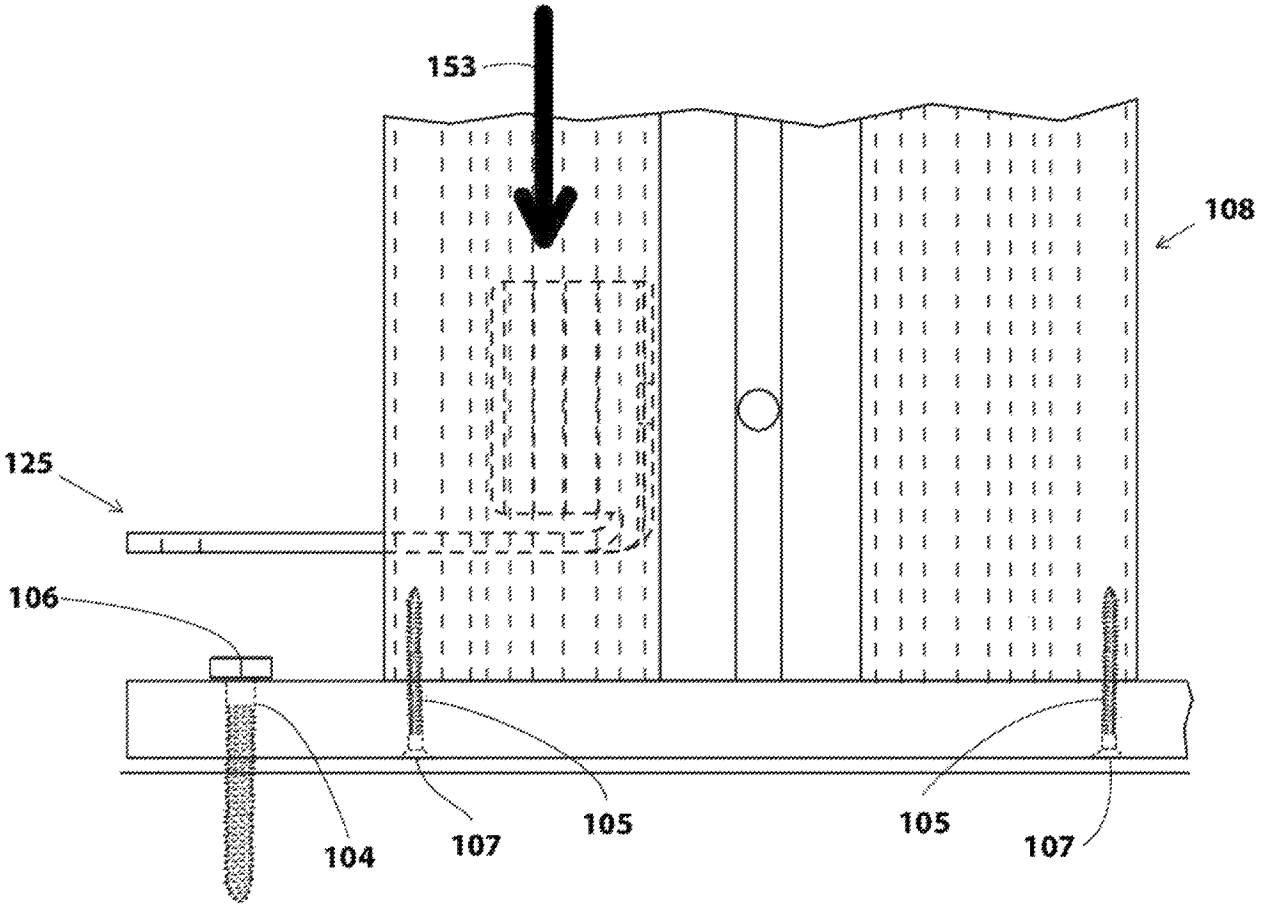

1) Screwing post-supporting post screws 107 through post-supporting post-screw holes 105 into post-locking shafts 119, 120, 121, and 122, to secure fence-post base systems 101 to fence-post systems 108, respectively;

2) Screwing post-supporting base screws 106 through post-supporting base-screw holes 104 into a foundation or patio, to secure fence-post base systems 101 to the foundation or patio, respectively;

Assembly of Close-To-Post-Base Bracket Clamp to Post 3) (FIGS. 12A and 12B)

Squeezing springable hand-free-self-locking self-centering bracket-clamp jaws 127 and springable hand-free-self-locking self-centering bracket-clamp teeth 128, in the directions of arrows 151 and 152;

4) (FIG. 13)

Inserting (right side up or upside down)
springable hand-free-self-locking self-centering bracket-clamp jaws 127 and
springable hand-free-self-locking self-centering bracket-clamp groove 129 into
first bracket-clamp-locking jaw slot 113 and
first bracket-clamp-centering groove 114, respectively,
in the direction of arrow 153:

a) To center springable hand-free-self-locking self-centering bracket-clamp groove 129 in fence-post board-expansion internal gap 124,
b) To center springable hand-free-self-locking self-centering bracket-clamp teeth 128 in fence-post board-expansion internal gap 124,
c) To center springable hand-free-self-locking self-centering bracket-clamp jaws 127 in fence-post board-expansion internal gap 124,
d) To center springable hand-free-self-locking self-centering bracket-clamp body 126 in fence-post board-expansion internal gap 124,
e) To center springable hand-free-self-locking self-centering bracket-clamp systems 125 in fence-post board-expansion internal gaps 124, respectively;

5) (FIG. 14)

Figure 15A:
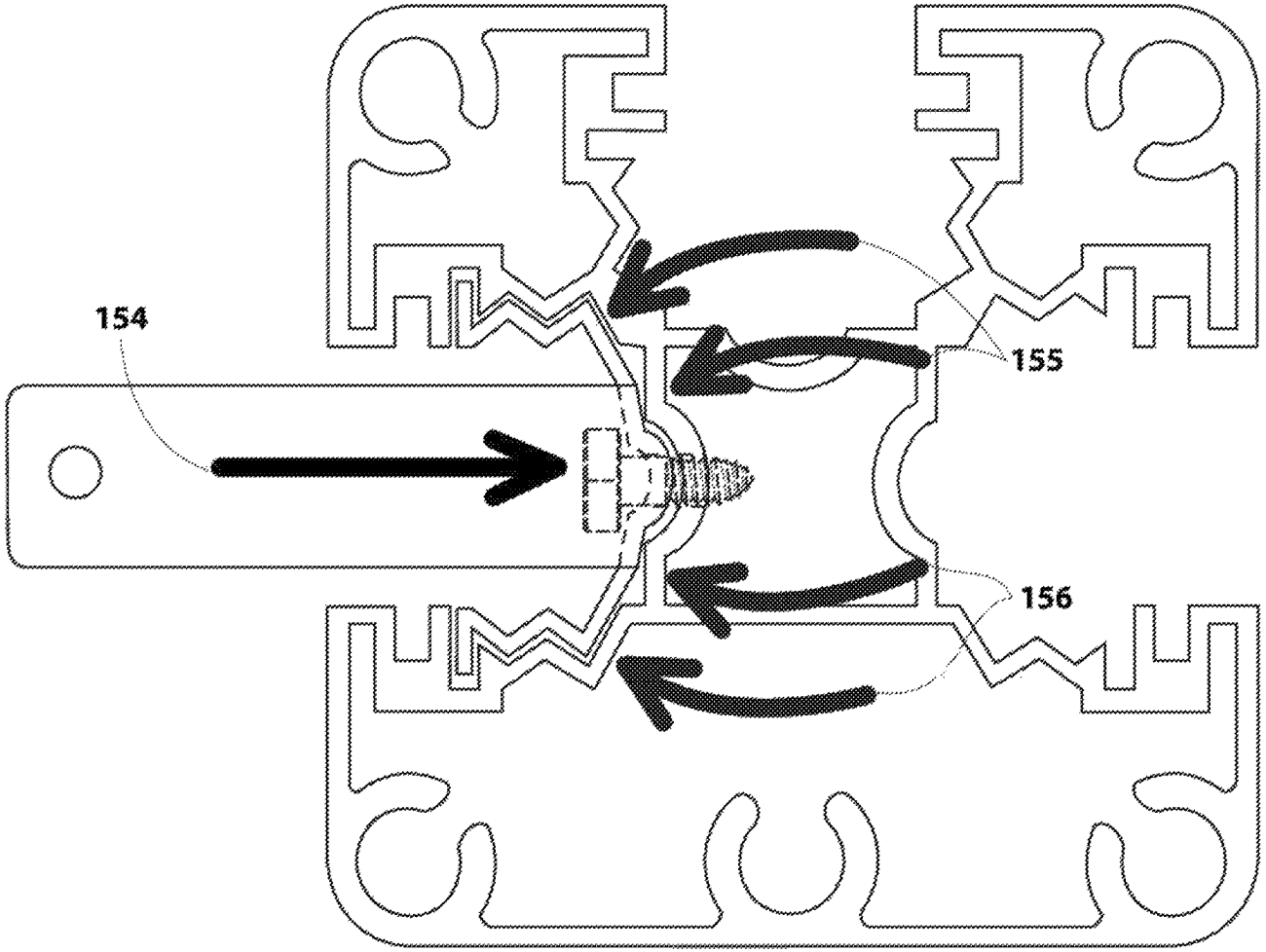
Figure 15B:
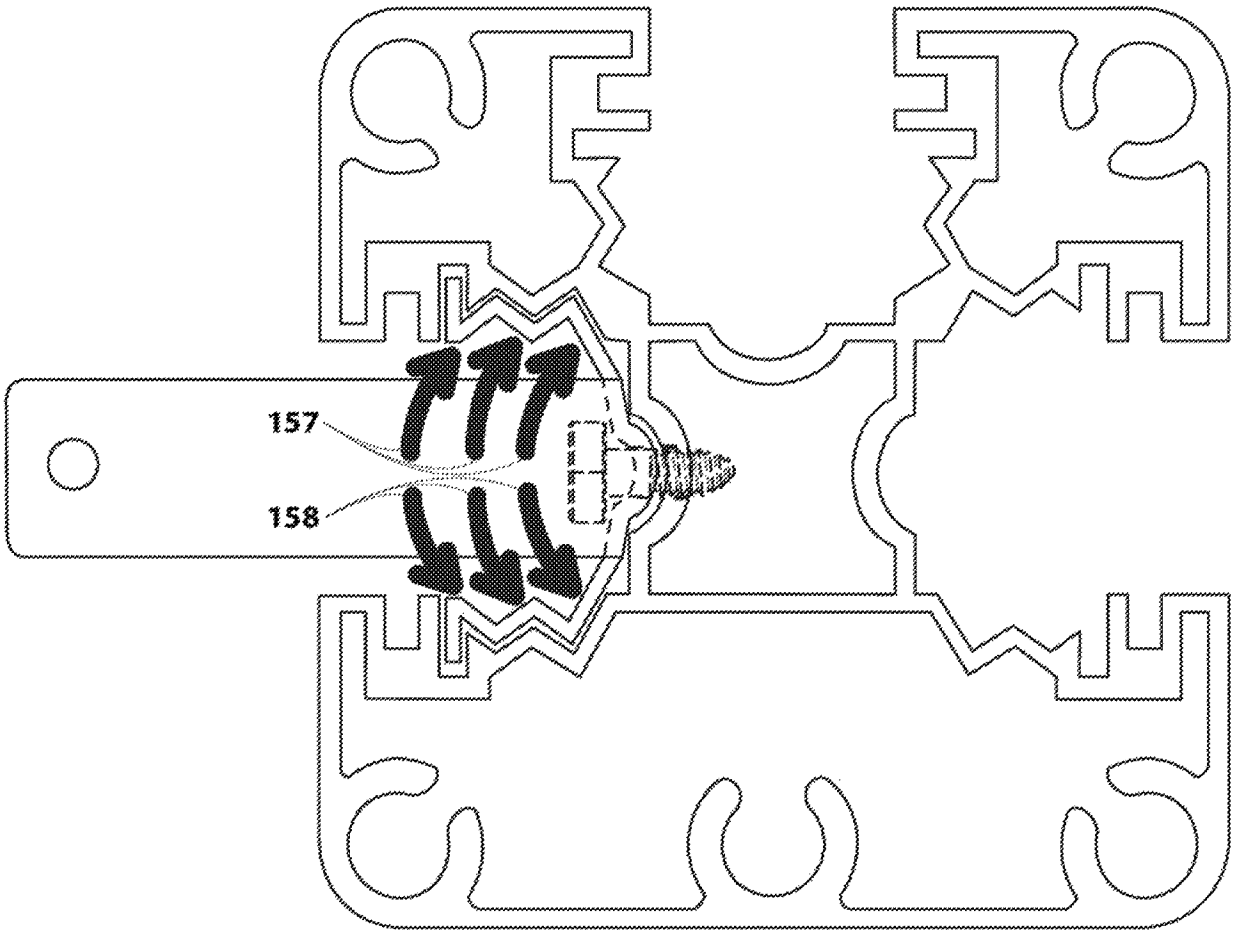

Sliding springable hand-free-self-locking self-centering bracket-clamp system 125 to a location close to fence-post base system 101:

a) To springably lock hand-free-self-locking self-centering bracket-clamp groove 129 in fence-post board-expansion internal gap 124,
b) To springably lock hand-free-self-locking self-centering bracket-clamp teeth 128 in fence-post board-expansion internal gap 124,
c) To springably lock hand-free-self-locking self-centering bracket-clamp jaws 127 in fence-post board-expansion internal gap 124,
d) To springably lock hand-free-self-locking self-centering bracket-clamp body 126 in fence-post board-expansion internal gap 124,
e) To springably lock hand-free-self-locking self-centering bracket-clamp systems 125 in fence-post board-expansion internal gaps 124, respectively;

6) (FIGS. 15A and 15B)

Figure 16:
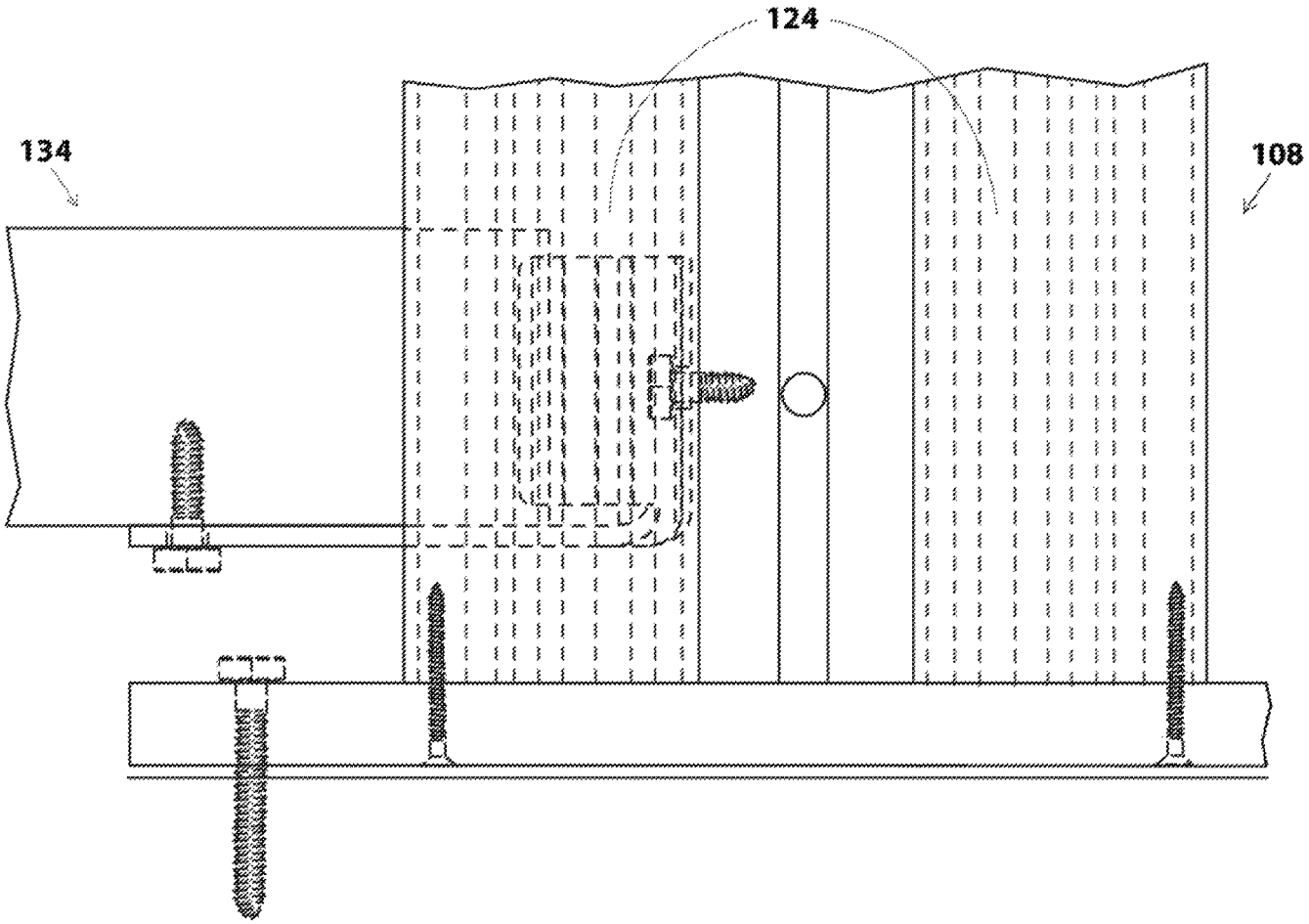
FIGS. 16, 17A, and 17B illustrate side views of how to assemble and secure the board-expansion-internal-gap rail system and the stackable interlocking fence-board system to the springable hand-free-self-locking self-centering bracket-clamp system.

Screwing springable hand-free-self-locking self-centering bracket-clamp screw 133 through springable hand-free-self-locking self-centering bracket-clamp hole 131 through
first bracket-clamp-centering groove 114,
in the direction of arrow 154:

a) To create springably locking forces from springable hand-free-self-locking self-centering bracket-clamp jaws 127, in the directions of arrows 155 and 156,
to make them function as a springably locking washer to secure springable hand-free-self-locking self-centering bracket-clamp screws 133,
b) To increase biting forces from springable hand-free-self-locking self-centering bracket-clamp teeth 128, in the directions of arrows 157 and 158,
c) To secure springable hand-free-self-locking self-centering bracket-clamp systems 125 to fence-post systems 108, respectively;

Assembly of Rail to Close-To-Post-Base Bracket Clamp 7) (FIG. 16)

Figure 17A:
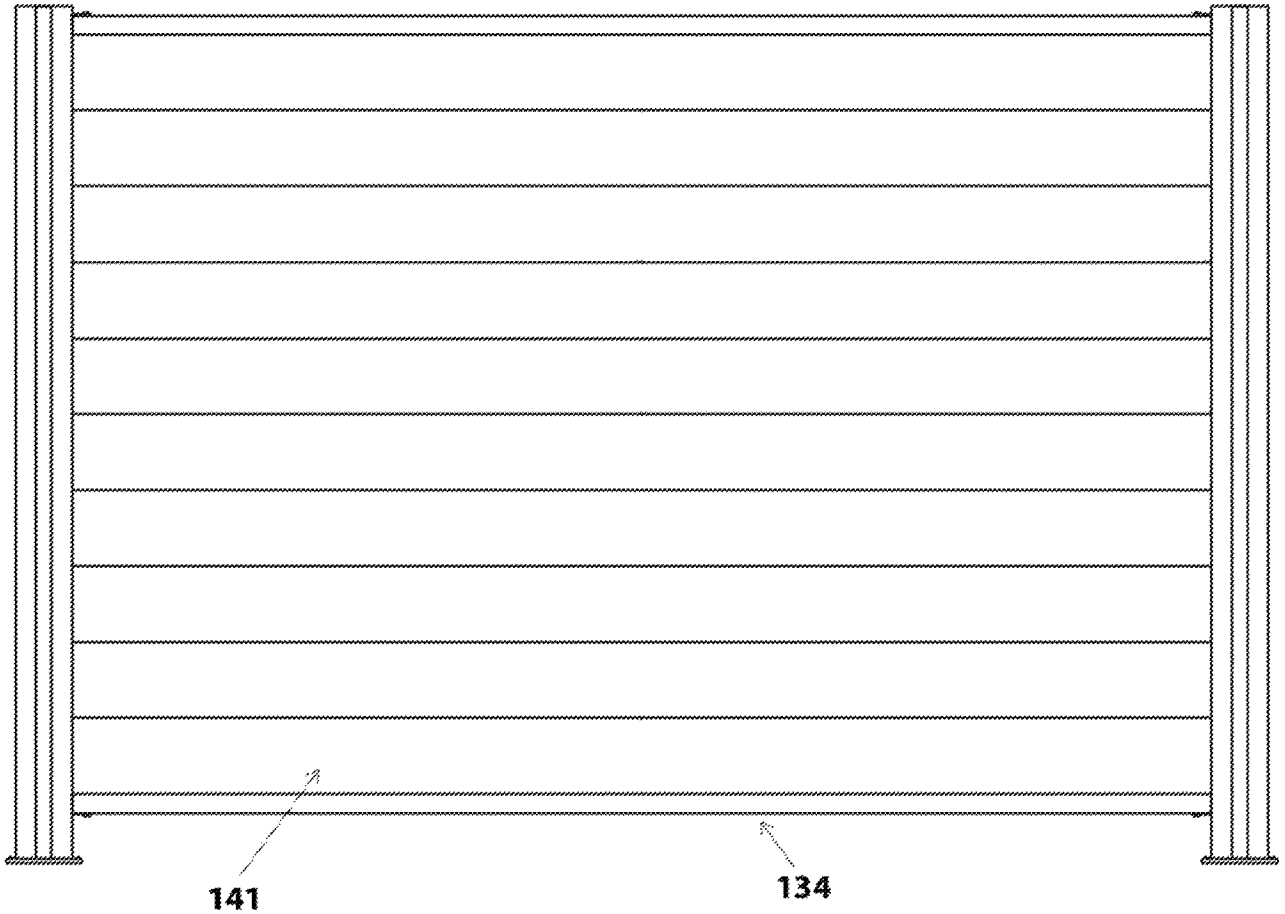
Figure 17B:
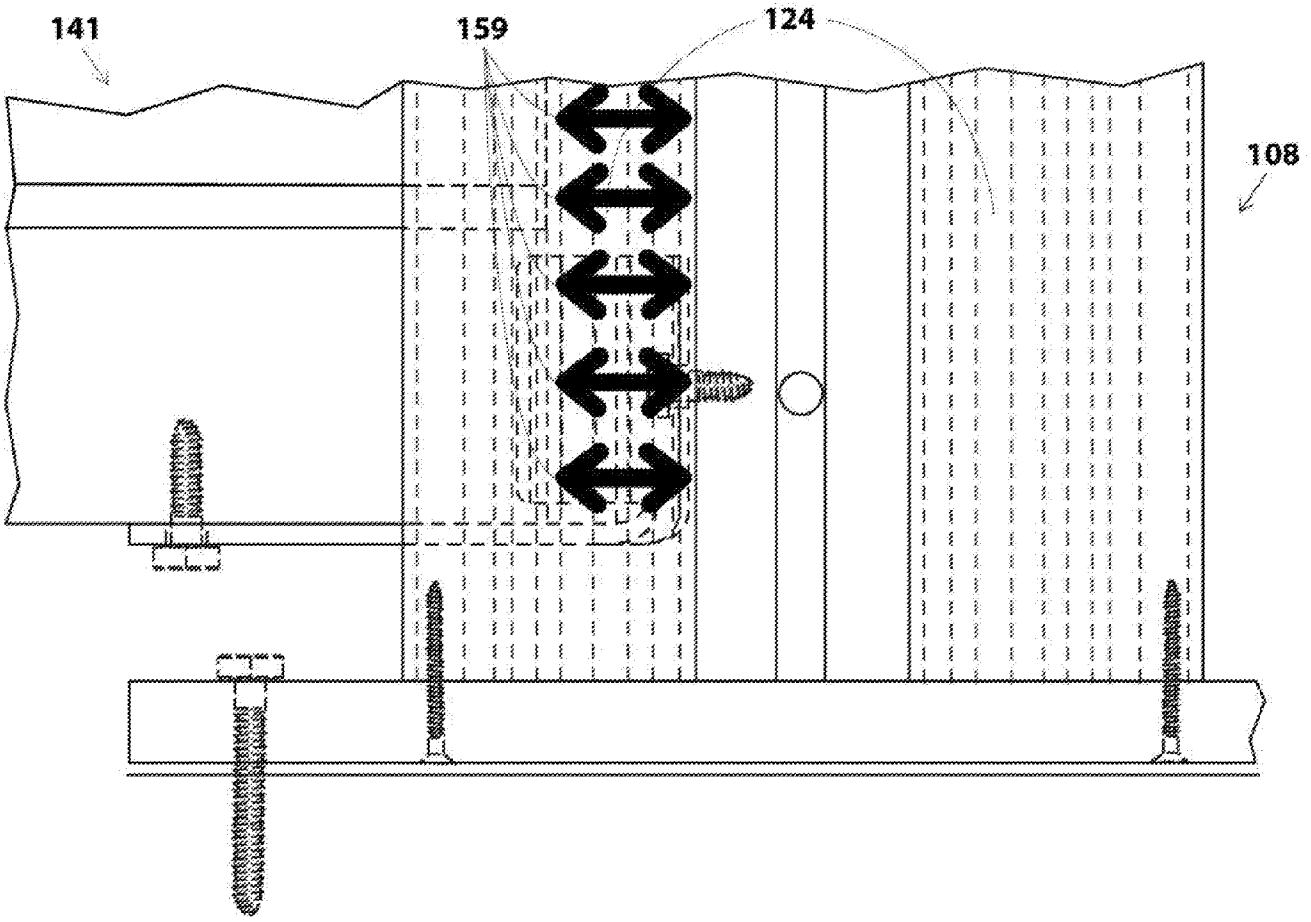

Screwing springable hand-free-self-locking self-centering bracket-body screw 132 through springable hand-free-self-locking self-centering bracket-body hole 130 through U-shaped-rail first-end hole 138 and U-shaped-rail second-end hole 139:

a) To center U-shaped-rail body 135 in fence-post board-expansion internal gap 124,
b) To center board-expansion-internal-gap rail systems 134 in fence-post board-expansion internal gaps 124, respectively;

Assembly of Fence Board on Rail and into Post 8) (FIGS. 17A and 17B)

Figure 18:
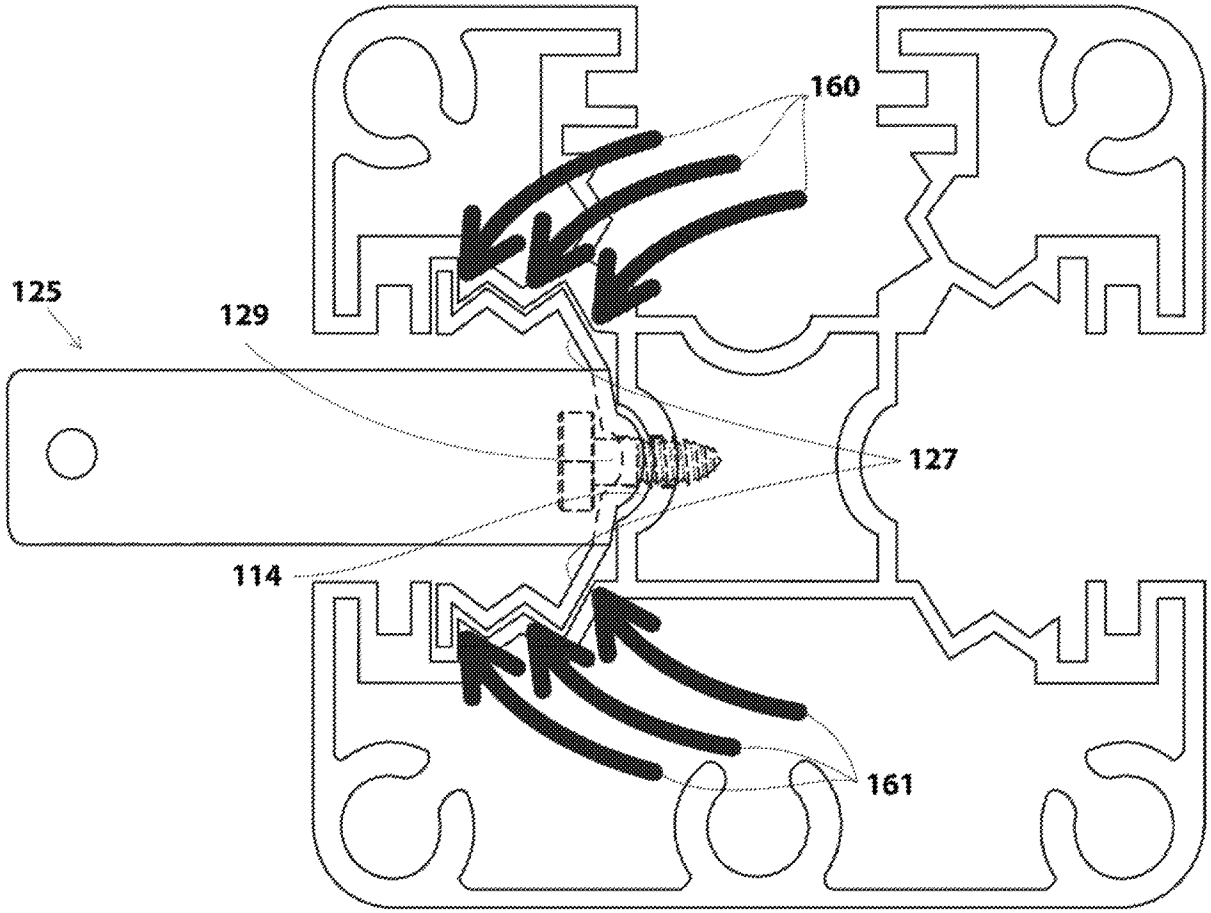
FIG. 18 illustrates a top view of how the springable hand-free-self-locking self-centering bracket-clamp system works.
Figure 19A:
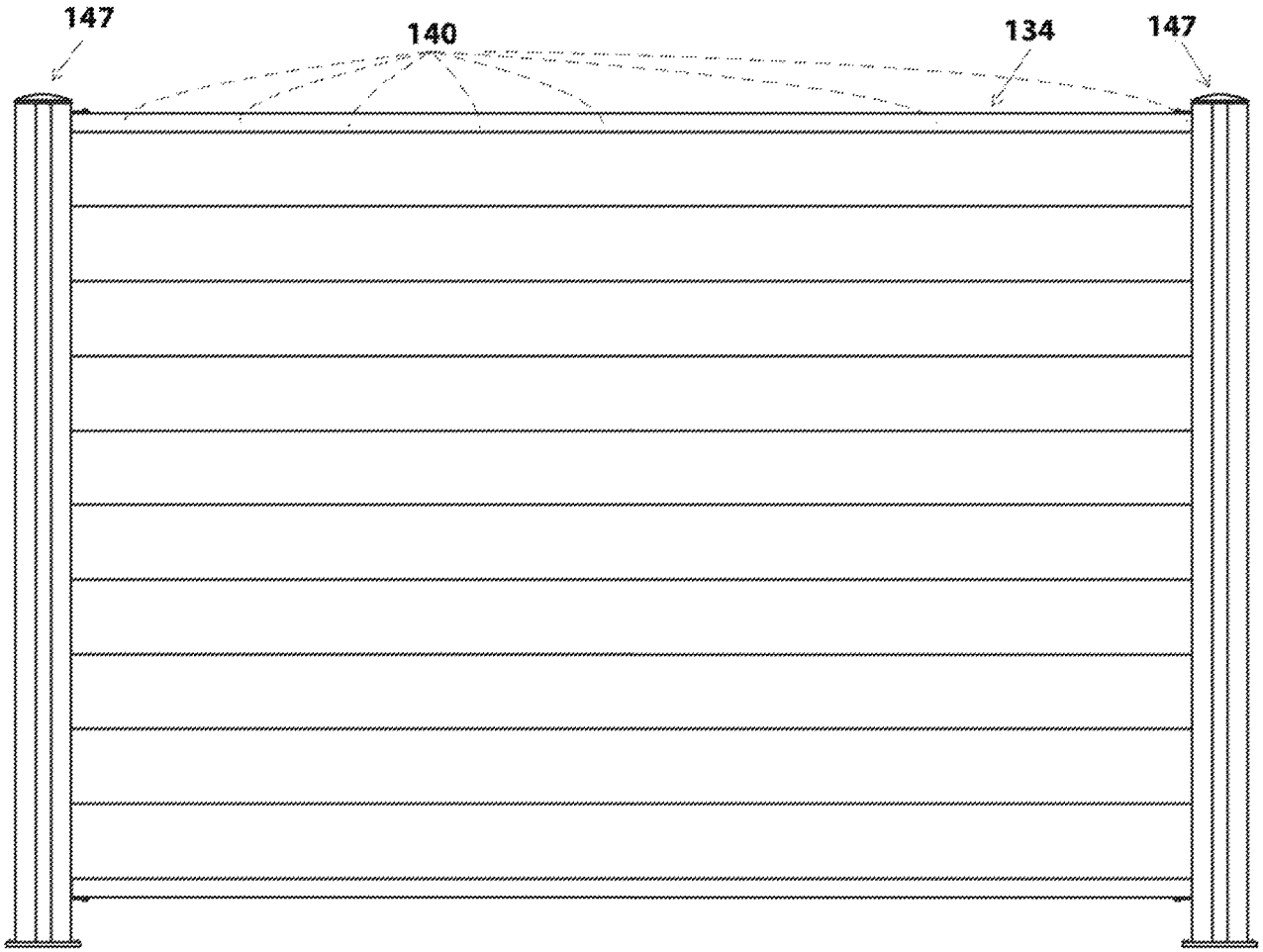
FIGS. 19A, 19B, and 20 illustrate top and side views of how to assemble and secure the springable hand-free-self-locking self-centering bracket-clamp system and the slot cover to the fence-post system.
Figure 19B:
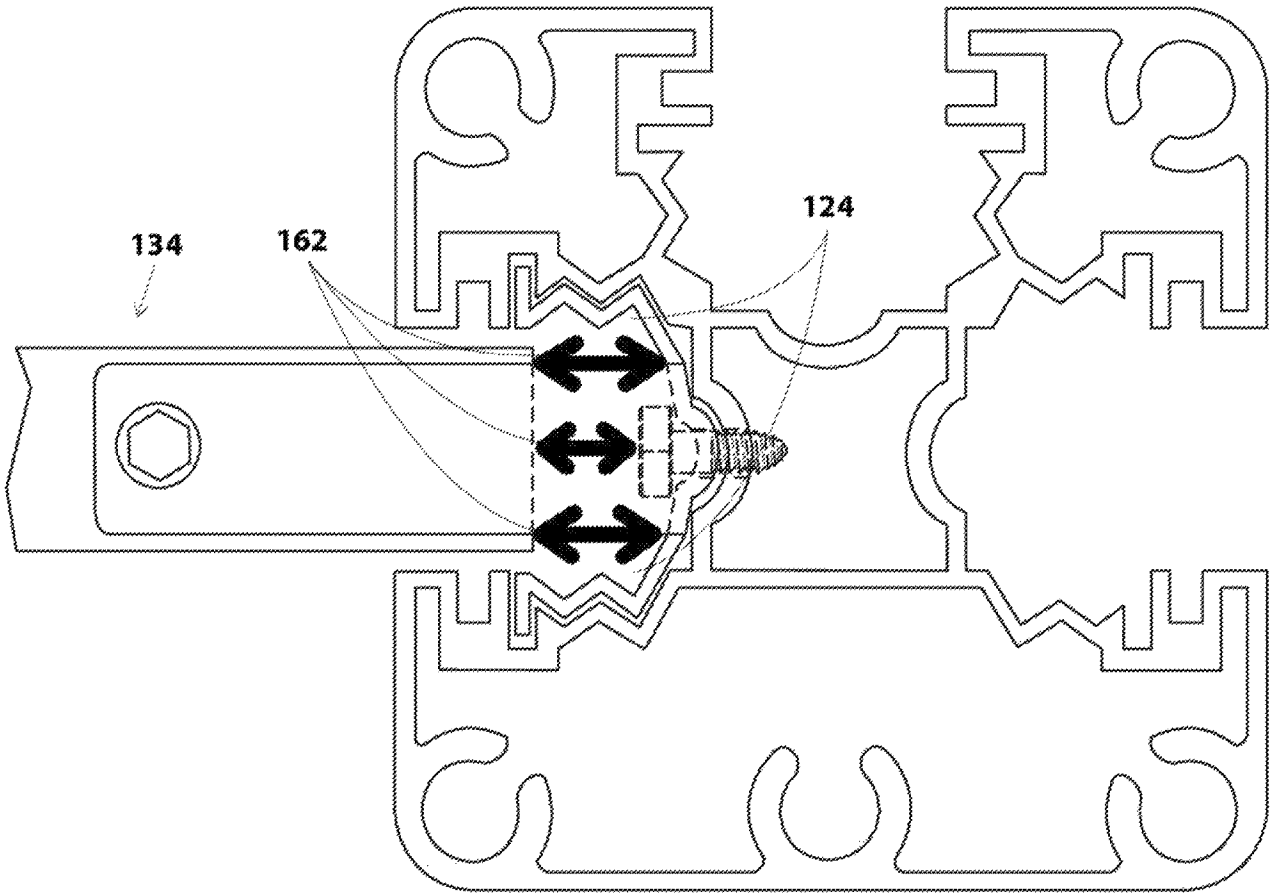
Figure 20:
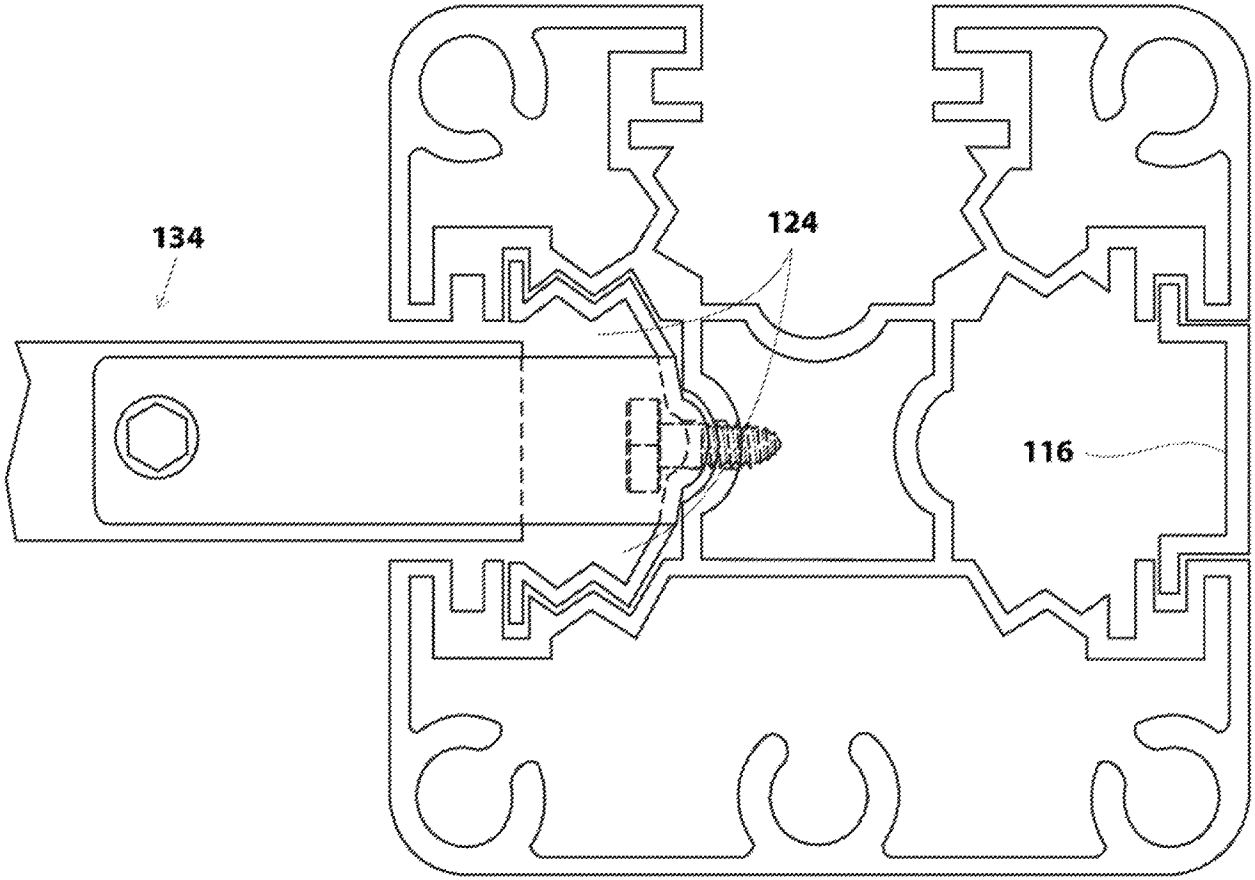

Stacking stackable interlocking fence-board system 141 on board-expansion-internal-gap rail system 134, and
Inserting stackable-interlocking-fence-board first end 143 and stackable-interlocking-fence-board second end 144 into fence-post board-expansion internal gap 124, respectively:

i) To accommodate expansion and contraction of stackable interlocking fence-board systems 141 inside fence-post board-expansion internal gap 124 of fence-post system 108,
in the directions of arrows 159,
to prevent stackable interlocking fence-board systems 141 from warping, bending, and breaking; and
j) To allow deep insertion of stackable interlocking fence-board systems 141 into fence-post board-expansion internal gap 124 of fence-post system 108, to eliminate the empty space (created when stackable interlocking fence-board systems 141 contract under cold weather) between stackable interlocking fence-board systems 141 and fence-post systems 108 to provide seamless barriers for privacy and to reinforce the unique springable hand-free-self-locking self-centering bracket-clamp fence system;

Assembly of Close-To-Post-Cap Bracket Clamp to Post 9) (FIG. 18)

Squeezing springable hand-free-self-locking self-centering bracket-clamp jaws 127, in the directions of arrows 160 and 161;

10) Inserting (right side up or upside down)
springable hand-free-self-locking self-centering bracket-clamp jaws 127 and
springable hand-free-self-locking self-centering bracket-clamp groove 129 into
first bracket-clamp-locking jaw slot 113 and
first bracket-clamp-centering groove 114, respectively:
a) To center springable hand-free-self-locking self-centering bracket-clamp groove 129 in fence-post board-expansion internal gap 124,
b) To center springable hand-free-self-locking self-centering bracket-clamp teeth 128 in fence-post board-expansion internal gap 124,
c) To center springable hand-free-self-locking self-centering bracket-clamp jaws 127 in fence-post board-expansion internal gap 124,
d) To center springable hand-free-self-locking self-centering bracket-clamp body 126 in fence-post board-expansion internal gap 124,
e) To center springable hand-free-self-locking self-centering bracket-clamp systems 125 in fence-post board-expansion internal gaps 124, respectively;

11) Sliding springable hand-free-self-locking self-centering bracket-clamp system 125 to a location close to fence-post-covering cap system 147:
a) To springably lock hand-free-self-locking self-centering bracket-clamp groove 129 in fence-post board-expansion internal gap 124,
b) To springably lock hand-free-self-locking self-centering bracket-clamp teeth 128 in fence-post board-expansion internal gap 124,
c) To springably lock hand-free-self-locking self-centering bracket-clamp jaws 127 in fence-post board-expansion internal gap 124,
d) To springably lock hand-free-self-locking self-centering bracket-clamp body 126 in fence-post board-expansion internal gap 124,
e) To springably lock hand-free-self-locking self-centering bracket-clamp systems 125 in fence-post board-expansion internal gaps 124, respectively;

12) Screwing springable hand-free-self-locking self-centering bracket-clamp screw 133 through springable hand-free-self-locking self-centering bracket-clamp hole 131 through first bracket-clamp-centering groove 114:
a) To create springably locking forces from
springable hand-free-self-locking self-centering bracket-clamp jaws 127, in the directions of arrows 155 and 156 (FIG. 15A),
to make them function as a springably locking washer to secure springable hand-free-self-locking self-centering bracket-clamp screws 133,
b) To increase biting forces from
springable hand-free-self-locking self-centering bracket-clamp teeth 128, in the directions of arrows 157 and 158 (FIG. 15B),
c) To secure springable hand-free-self-locking self-centering bracket-clamp systems 125 to
fence-post systems 108, respectively;

Assembly of Rail to Close-To-Post-Cap Bracket Clamp 13) (FIGS. 19A and 19B)
Screwing springable hand-free-self-locking self-centering bracket-body screw 132 through springable hand-free-self-locking self-centering bracket-body hole 130 through U-shaped-rail first-end hole 138 and U-shaped-rail second-end hole 139, respectively:
a) To center U-shaped-rail body 135 in
fence-post board-expansion internal gap 124,
b) To center board-expansion-internal-gap rail systems 134 in
fence-post board-expansion internal gaps 124, respectively,
c) To accommodate expansion and contraction of stackable interlocking fence-board systems 141 inside U-shaped-rail board-expansion internal gap 140 of board-expansion-internal-gap rail system 134,
in the directions of arrows 162,
to prevent stackable interlocking fence-board systems 141 from warping, bending, and breaking;
d) To allow deep insertion of stackable interlocking fence-board systems 141 into fence-post board-expansion internal gap 124 of fence-post system 108,
to reinforce the unique springable hand-free-self-locking self-centering bracket-clamp fence system;

Assembly of Slot Cover 14) (FIG. 20)
Inserting first cover-locking-slot cover 112 or second cover-locking-slot covers 116 in first cover-locking slot 111 or second cover-locking slots 115, respectively; and Assembly of Cap on Post 15) (FIG. 19A)
Press-locking fence-post-covering-cap central locks 149 into cap-locking shafts 123, and fence-post-covering-cap perimeter locks 150 into the top of fence-post systems 108, respectively.

Variation

Springable hand-free-self-locking self-centering bracket-clamp system 125 can be on at least one side of fence-post system 108.

Figure 21:
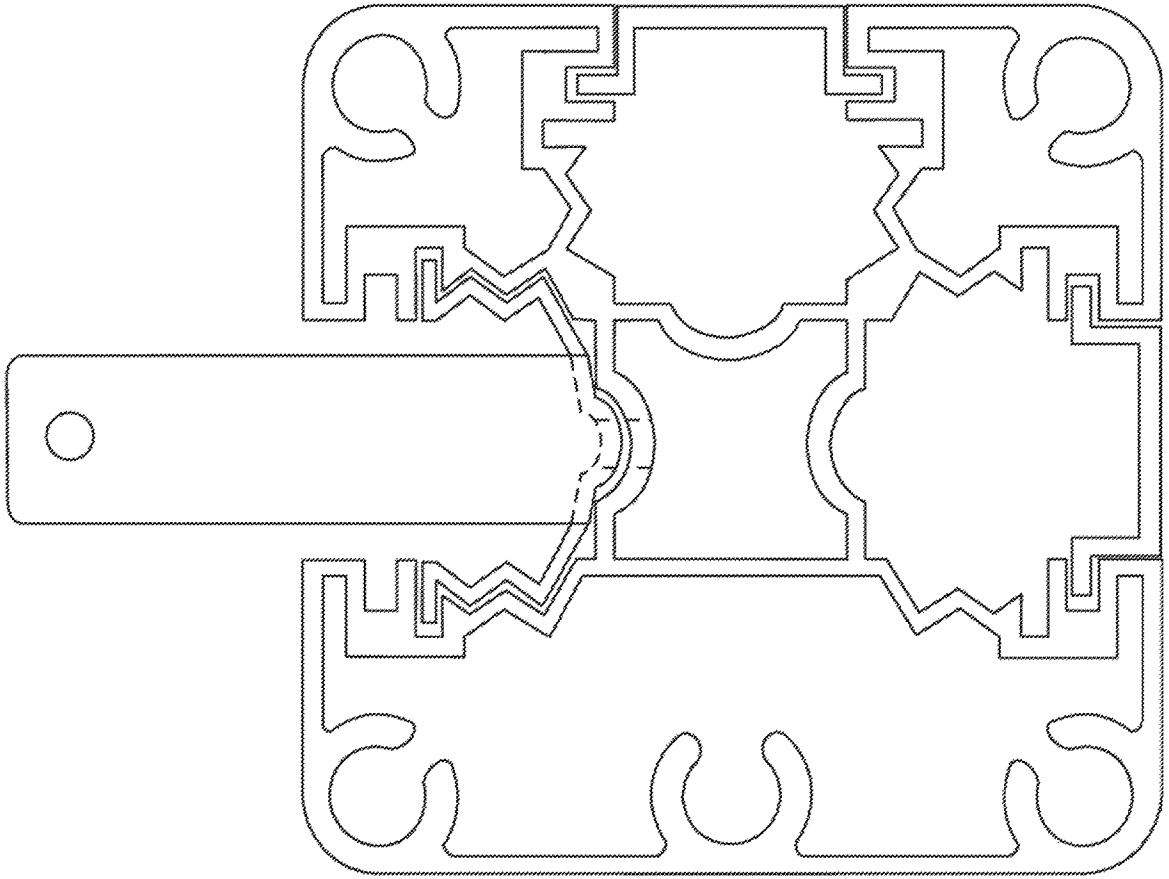
FIGS. 21, 22, 23, 24, 25, and 26 illustrate top views of variations of the springable hand-free-self-locking self-centering bracket-clamp system and the fence-post system of the unique springable hand-free-self-locking self-centering bracket-clamp fence system.

For example, FIG. 21 illustrates springable hand-free-self-locking self-centering bracket-clamp system 125 on one side of fence-post system 108.

Figure 22:
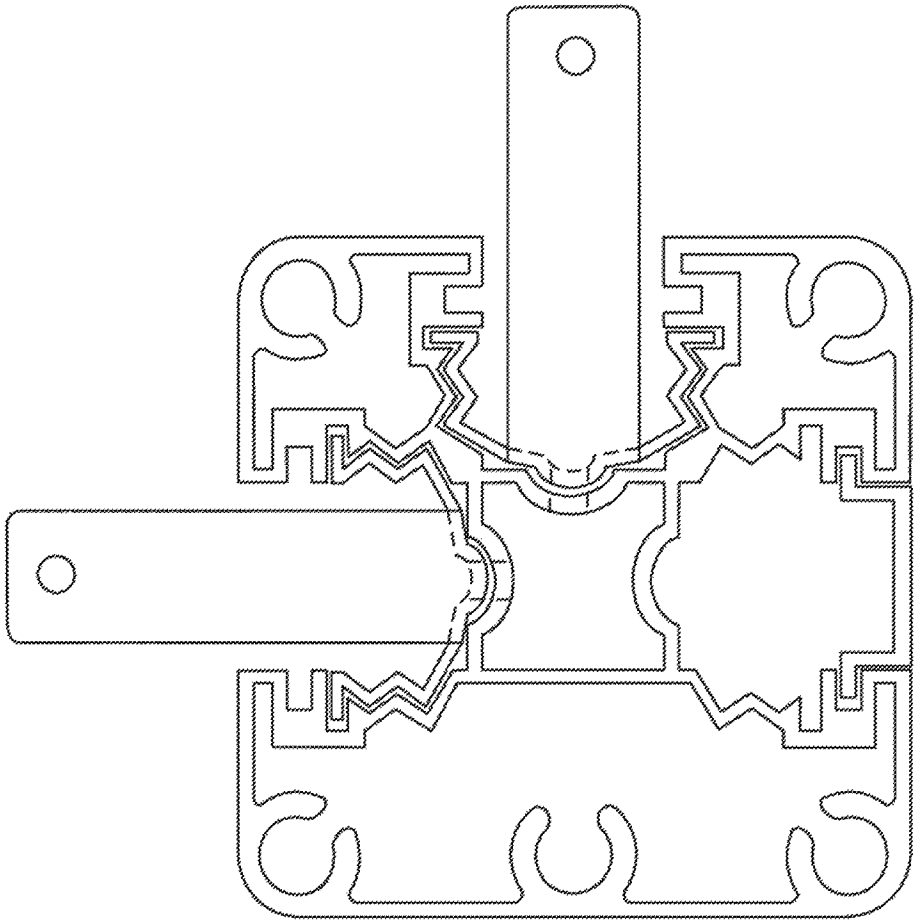

For another example, FIG. 22 illustrates springable hand-free-self-locking self-centering bracket-clamp system 125 on two sides of fence-post system 108.

Figure 23:
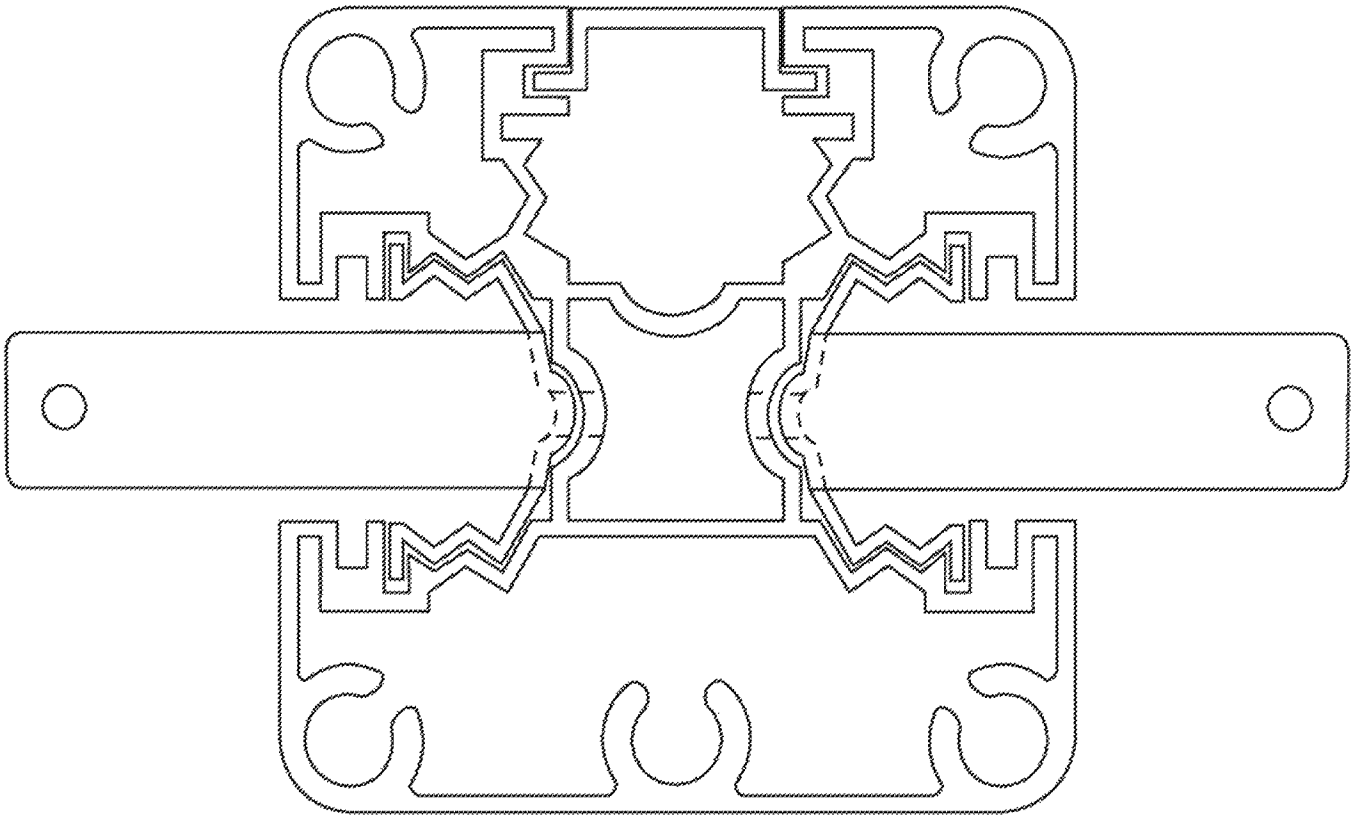

For another example, FIG. 23 illustrates springable hand-free-self-locking self-centering bracket-clamp system 125 on two sides of fence-post system 108.

Figure 24:
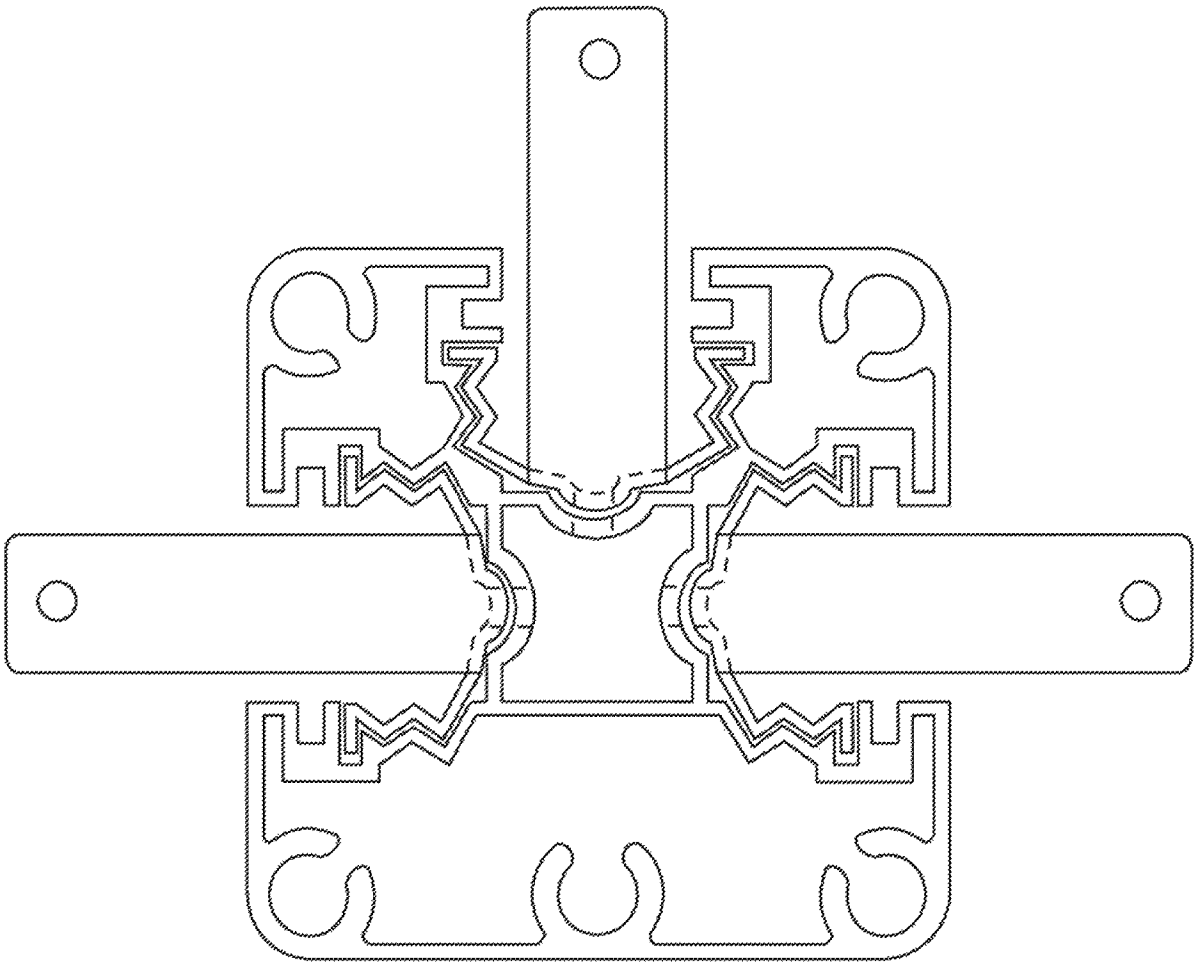

For another example, FIG. 24 illustrates springable hand-free-self-locking self-centering bracket-clamp system 125 on three sides of fence-post system 108.

For another example, springable hand-free-self-locking self-centering bracket-clamp system 125 can be on four sides of fence-post system 108.

Each component of the unique springable hand-free-self-locking self-centering bracket-clamp fence system can have any shape and size.

Figure 25:
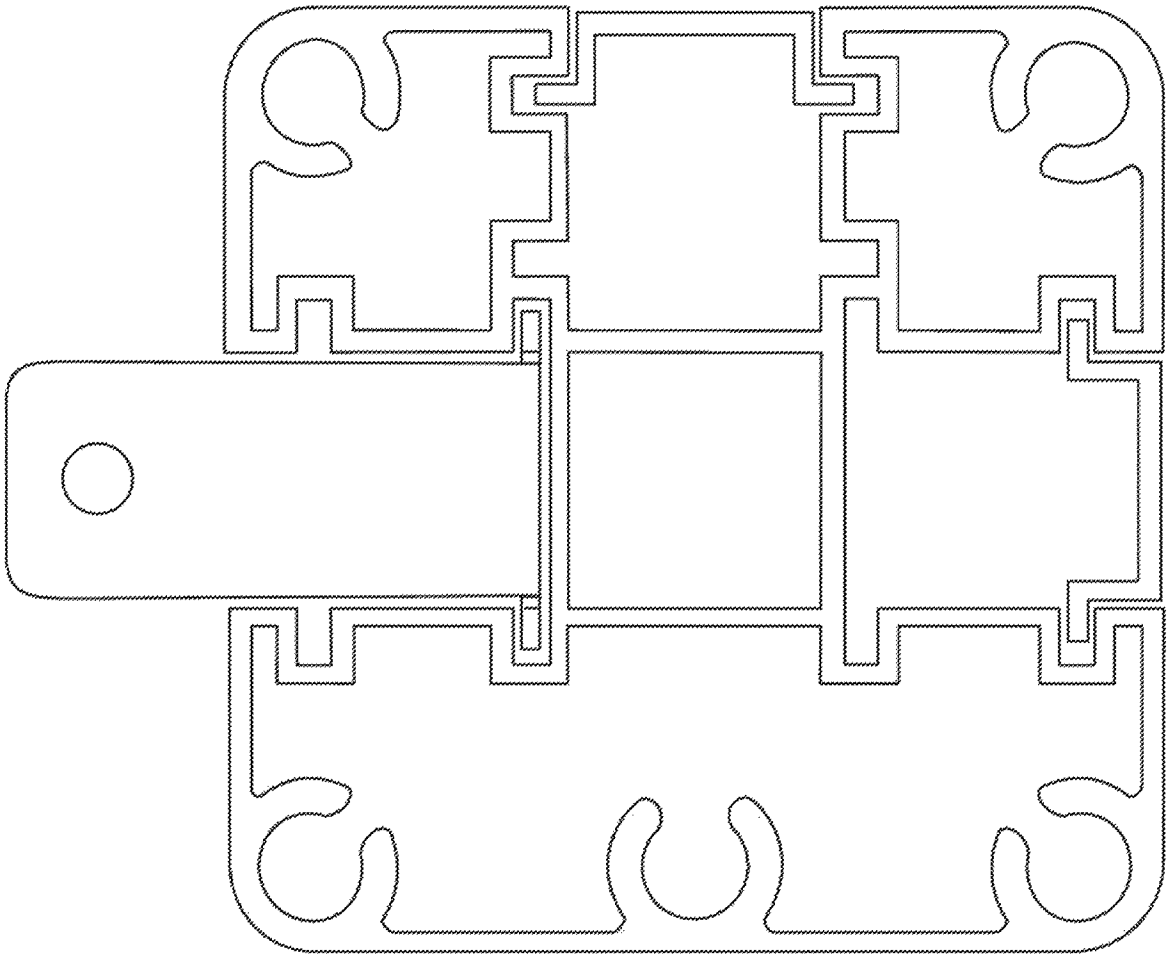

For another example, FIG. 25 illustrates a variation of fence-post system 108, which is equivalent to fence-post system 108.

For another example, FIG. 25 illustrates variations of first bracket-clamp-locking jaw slot 113 and second bracket-clamp-locking jaw slot 117, which are equivalent to them, respectively.

For example, FIG. 25 illustrates a variation 161 of springable hand-free-self-locking self-centering bracket-clamp system 125, which can have an L shape, and is equivalent to springable hand-free-self-locking self-centering bracket-clamp system 125.

For another example, springable hand-free-self-locking self-centering bracket-clamp system 125 can be created with or without springable hand-free-self-locking self-centering bracket-clamp jaws 127, springable hand-free-self-locking self-centering bracket-clamp teeth 128, and/or springable hand-free-self-locking self-centering bracket-clamp groove 129.

Figure 26:
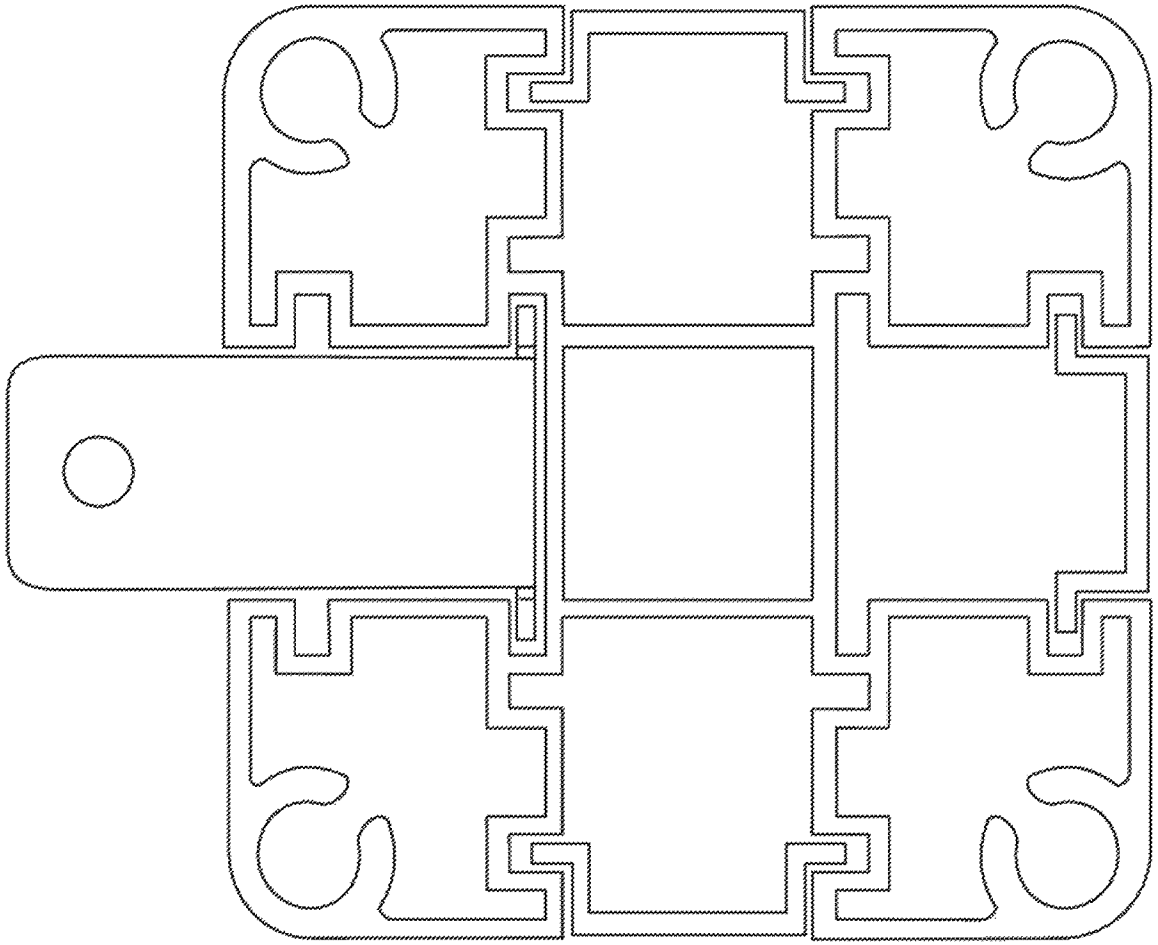

For another example, FIG. 26 illustrates a variation of fence-post system 108, which is equivalent to fence-post system 108.

Springable hand-free-self-locking self-centering bracket-clamp system 125, board-expansion-internal-gap rail system 134, and/or stackable interlocking fence-board system 141 each can be attached to fence-post system 108 at any angle, slope, grade, direction, or orientation.

Each component of fence-post systems 108 (for example, fence-post external walls 109, fence-post internal walls 110, first cover-locking slot 111, first cover-locking-slot cover 112, first bracket-clamp-locking jaw slot 113, first bracket-clamp-centering groove 114) can be molded at any angle, slope, grade, direction, or orientation, relative to other components.

Major Advantages of the Invention

The new invention substantially departs from the conventional concepts and designs of the prior art. In doing so, the new invention provides a unique springable hand-free-self-locking self-centering bracket-clamp fence system having many unique and significant features, functions, and advantages, which overcome all the disadvantages of the prior art, as follows:

1) It is an object of the new invention to provide a unique springable hand-free-self-locking self-centering bracket-clamp fence system, having
   first bracket-clamp-locking jaw slot 113.
   Therefore, the unique springable hand-free-self-locking self-centering bracket-clamp fence system:
   a) Can squeeze springable hand-free-self-locking self-centering bracket-clamp jaws 127 therein; and
   b) Can lock springable hand-free-self-locking self-centering bracket-clamp jaws 127 therein.
2) It is another object of the new invention to provide a unique springable hand-free-self-locking self-centering bracket-clamp fence system, having
   second bracket-clamp-locking jaw slot 117.
   Therefore, the unique springable hand-free-self-locking self-centering bracket-clamp fence system:
   a) Can squeeze springable hand-free-self-locking self-centering bracket-clamp jaws 127 therein; and
   b) Can lock springable hand-free-self-locking self-centering bracket-clamp jaws 127 therein.
3) It is a further object of the new invention to provide a unique springable hand-free-self-locking self-centering bracket-clamp fence system, having
   first bracket-clamp-centering groove 114.
   Therefore, the unique springable hand-free-self-locking self-centering bracket-clamp fence system:
   a) Can center springable hand-free-self-locking self-centering bracket-clamp groove 129 therein;
   b) Can center springable hand-free-self-locking self-centering bracket-clamp teeth 128 therein;
   c) Can center springable hand-free-self-locking self-centering bracket-clamp jaws 127 therein;
   d) Can center springable hand-free-self-locking self-centering bracket-clamp body 126 therein;
   e) Can center springable hand-free-self-locking self-centering bracket-clamp system 125 therein;
   f) Can center board-expansion-internal-gap rail systems 134; and
   g) Can center stackable interlocking fence-board systems 141.
4) It is an even further object of the new invention to provide a unique springable hand-free-self-locking self-centering bracket-clamp fence system, having
   second bracket-clamp-centering groove 118.
   Therefore, the unique springable hand-free-self-locking self-centering bracket-clamp fence system:
   a) Can center springable hand-free-self-locking self-centering bracket-clamp groove 129 therein;
   b) Can center springable hand-free-self-locking self-centering bracket-clamp teeth 128 therein;
   c) Can center springable hand-free-self-locking self-centering bracket-clamp jaws 127 therein;
   d) Can center springable hand-free-self-locking self-centering bracket-clamp body 126 therein;
   e) Can center springable hand-free-self-locking self-centering bracket-clamp system 125 therein;
   f) Can center board-expansion-internal-gap rail systems 134; and
   g) Can center stackable interlocking fence-board systems 141.
5) It is another object of the new invention to provide a unique springable hand-free-self-locking self-centering bracket-clamp fence system, having
   springable hand-free-self-locking self-centering bracket-clamp jaws 127.
   Therefore, the unique springable hand-free-self-locking self-centering bracket-clamp fence system:
   a) Can be squeezed into jaw slot 113, 117, or 121;
   b) Can springably and temporarily secure springable hand-free-self-locking self-centering bracket-clamp system 125 in place, to eliminate the need for holding it while screwing it to fence-post system 108;
   c) Can reduce fence-installing time, by eliminating the need for manually holding springable hand-free-self-locking self-centering bracket-clamp system 125 while installing the unique hand-free-springable self-locking self-centering bracket-clamp fence system; and
   d) Can function as a springably locking washer to springably lock springable hand-free-self-locking self-centering bracket-clamp screw 133 to fence-post system 108.
6) It is yet another object of the new invention to provide a unique springable hand-free-self-locking self-centering bracket-clamp fence system, having
   springable hand-free-self-locking self-centering bracket-clamp teeth 128.
   Therefore, the unique springable hand-free-self-locking self-centering bracket-clamp fence system:
   a) Can bite into jaw slot 113, 117, or 121,
      to lock springable hand-free-self-locking self-centering bracket-clamp systems 125 therein at any desired elevation; and
   b) Can bite into jaw slot 113, 117, or 121,
      to eliminate the needs for having a person to hold springable hand-free-self-locking self-centering bracket-clamp systems 125 therein at any desired elevation.
7) It is still yet another object of the new invention to provide a unique springable hand-free-self-locking self-centering bracket-clamp fence system, having springable hand-free-self-locking self-centering bracket-clamp groove 129.

Therefore, the unique springable hand-free-self-locking self-centering bracket-clamp fence system:

a) Can slide in bracket-clamp-centering groove 114, 118, or 122;

b) Can center springable hand-free-self-locking self-centering bracket-clamp teeth 128 therein;

c) Can center springable hand-free-self-locking self-centering bracket-clamp jaws 127 therein;

d) Can center springable hand-free-self-locking self-centering bracket-clamp body 126 therein; and e) Can center springable hand-free-self-locking self-centering bracket-clamp system 125 therein.

8) It is still yet an even further object of the new invention to provide a unique springable hand-free-self-locking self-centering bracket-clamp fence system, having U-shaped-rail board-expansion internal gap 140.

Therefore, the unique springable hand-free-self-locking self-centering bracket-clamp fence system:

a) Can accommodate expansion and contraction of stackable interlocking fence-board systems 141 inside u-shaped-rail board-expansion internal gap 140 of board-expansion-internal-gap rail system 134, to prevent stackable interlocking fence-board systems 141 from warping, bending, and breaking;

b) Can allow deep insertion of stackable interlocking fence-board systems 141 into u-shaped-rail board-expansion internal gap 140 of board-expansion-internal-gap rail system 134, to reinforce the unique springable hand-free-self-locking self-centering bracket-clamp fence system;

c) Can support stackable interlocking fence-board systems 141; and d) Can lock stackable-interlocking-fence-board ridge 146 therein.

What is claimed is:

1. A springable hand-free-self-locking self-centering bracket-clamp fence system comprising:

a fence-post base comprising:

a post-supporting base, and at least one base screw;

a fence-post comprising:

a plurality of fence-post external walls, a plurality of fence-post internal walls, at least one bracket-clamp-locking jaw slot, at least one bracket-clamp-centering groove, at least one post-locking hole, and at least one fence-post board-expansion internal gap;

a plurality of springable hand-free-self-locking self-centering bracket-clamps, each comprising:

a springable hand-free-self-locking self-centering bracket-clamp body, at least one springable hand-free-self-locking self-centering bracket-clamp jaw, at least one springable hand-free-self-locking self-centering bracket-clamp tooth, at least one springable hand-free-self-locking self-centering bracket-clamp groove, and at least one bracket-clamp screw;

two board-expansion-internal-gap rails, each comprising:

a u-shaped-rail body, a u-shaped-rail first end, a u-shaped-rail second end, and a u-shaped-rail board-expansion internal gap;

a plurality of stackable interlocking fence-boards, each comprising:

a stackable-interlocking-fence-board body, a stackable-interlocking-fence-board first end, a stackable-interlocking-fence-board second end, a stackable-interlocking-fence-board slot, and a stackable-interlocking-fence-board ridge; and a fence-post-covering cap comprising:

a fence-post-covering cap body, a fence-post-covering-cap central lock, a fence-post-covering-cap perimeter lock, wherein:

said fence-post base is screwed to said fence-post, said at least one base screw is screwed through said fence-post base and into said at least one post-locking hole to attach said fence-post base to said fence-post, said fence-post external walls each are molded to another one of said fence-post external walls and to one of said fence-post internal walls to form a square-cross-sectional post such that:

each of said at least one bracket-clamp-locking jaw slot is formed between two of said fence-post external walls and between two of said fence-post internal walls, each of said at least one bracket-clamp-centering groove is formed in one of said fence-post internal walls and is engaged to one of said at least one bracket-clamp-locking jaw slot, each of said at least one post-locking hole is formed along where every two adjacent ones of said fence-post external walls are molded to each other, and each of said at least one fence-post board-expansion internal gap is formed between two of said fence-post internal walls and is engaged to one of said at least one bracket-clamp-locking jaw slot, said springable hand-free-self-locking self-centering bracket-clamps are screwed to said fence-post and to said stackable interlocking fence-boards, said springable hand-free-self-locking self-centering bracket-clamp body has a body end, said at least one springable hand-free-self-locking self-centering bracket-clamp jaw has two opposite jaw ends, said body end of said springable hand-free-self-locking self-centering bracket-clamp body is molded to said at least one springable hand-free-self-locking self-centering bracket-clamp jaw between said two opposite jaw ends, said at least one springable hand-free-self-locking self-centering bracket-clamp tooth are molded to said two opposite jaw ends, said at least one springable hand-free-self-locking self-centering bracket-clamp groove is formed in said at least one springable hand-free-self-locking self-centering bracket-clamp jaw between said two opposite jaw ends, said springable hand-free-self-locking self-centering bracket-clamp body is inserted into one of said at least one fence-post board-expansion internal gap and is screwed on one of said u-shaped-rail first end and said u-shaped-rail second end by using one of said at least one bracket-clamp screw, said at least one springable hand-free-self-locking self-centering bracket-clamp groove is aligned with one of said at least one bracket-clamp-centering groove, said at least one springable hand-free-self-locking self-centering bracket-clamp jaw is inserted into one of said at least one bracket-clamp-locking jaw slot and is screwed on one of said fence-post internal walls by using another one of said at least one bracket-clamp screw, said two board-expansion-internal-gap rail systems are screwed to said two springable hand-free-self-locking self-centering bracket-clamps, respectively, said u-shaped-rail body is molded to said u-shaped-rail first end and said u-shaped-rail second end to create said u-shaped-rail board-expansion internal gap therein, said stackable interlocking fence-boards are slid into said at least one fence-post board-expansion internal gap and into said u-shaped-rail board-expansion internal gap, respectively, said stackable-interlocking-fence-board body is molded to said stackable-interlocking-fence-board first end, said stackable-interlocking-fence-board second end, said stackable-interlocking-fence-board slot, and said stackable-interlocking-fence-board ridge, said fence-post-covering cap has a center and a perimeter, said fence-post-covering cap is press-locked on said fence-post, said fence-post-covering-cap central lock is molded to said fence-post-covering cap body in said center, said fence-post-covering-cap perimeter locks is molded to said fence-post-covering cap body along said perimeter, wherein:

said post-supporting base is for supporting said fence-post, said base screws are for screwing through said post-supporting base into said at least one post-locking hole, said fence-post external walls are for supporting said fence-post internal walls, said fence-post internal walls are for supporting said fence-post external walls, said at least one bracket-clamp-locking jaw slot is for:

squeezing said at least one springable hand-free-self-locking self-centering bracket-clamp jaw therein, and locking said at least one springable hand-free-self-locking self-centering bracket-clamp jaw therein, said at least one bracket-clamp-centering groove is for:

centering said at least one springable hand-free-self-locking self-centering bracket-clamp groove therein, centering said at least one springable hand-free-self-locking self-centering bracket-clamp tooth therein, centering said at least one springable hand-free-self-locking self-centering bracket-clamp jaw therein, centering said at least one springable hand-free-self-locking self-centering bracket-clamp body therein, centering said springable hand-free-self-locking self-centering bracket-clamps therein, centering said board-expansion-internal-gap rails, and centering said stackable interlocking fence-boards, said at least one post-locking hole is for screwing said base screws therein, said at least one fence-post board-expansion internal gap is for:

accommodating expansion and contraction of said stackable interlocking fence-boards inside said at least one fence-post board-expansion internal gap of said fence-post, to prevent said stackable interlocking fence-boards from warping, bending, and breaking, and allowing deep insertion of said stackable interlocking fence-boards into said at least one fence-post board-expansion internal gap of said fence-post, to eliminate the empty space created when said stackable interlocking fence-boards contract under cold weather between said stackable interlocking fence-boards and said fence-post to provide seamless barriers for privacy and to reinforce the springable hand-free-self-locking self-centering bracket-clamp fence system, said springable hand-free-self-locking self-centering bracket-clamp body is for attaching said board-expansion-internal-gap rails to said at least one springable hand-free-self-locking self-centering bracket-clamp jaw, said at least one springable hand-free-self-locking self-centering bracket-clamp jaw is for:

being squeezed into said at least one bracket-clamp-locking jaw slot, springably and temporarily securing said springable hand-free-self-locking self-centering bracket-clamps in place, to eliminate the need for holding it while screwing it to said fence-post, reducing fence-installing time, by eliminating the need for manually holding said springable hand-free-self-locking self-centering bracket-clamps while installing the hand-free-springable self-locking self-centering bracket-clamp fence system, and functioning as a springably locking washer to springably lock said at least one bracket-clamp screw to said fence-post, said at least one springable hand-free-self-locking self-centering bracket-clamp tooth is for biting into said at least one jaw slot, said at least one springable hand-free-self-locking self-centering bracket-clamp groove is for:

sliding in said at least one bracket-clamp-centering groove, centering said at least one springable hand-free-self-locking self-centering bracket-clamp tooth therein, centering said at least one springable hand-free-self-locking self-centering bracket-clamp jaw therein, centering said springable hand-free-self-locking self-centering bracket-clamp body therein, and centering said springable hand-free-self-locking self-centering bracket-clamps therein, said at least one bracket-clamp screw is for screwing through said at least one springable hand-free-self-locking self-centering bracket-clamp groove into said fence-post, to secure said springable hand-free-self-locking self-centering bracket-clamps to said fence-post, said u-shaped-rail body is for supporting said stackable interlocking fence-boards, said u-shaped-rail first end is for inserting into said at least one fence-post board-expansion internal gap, said u-shaped-rail second end is for inserting into said at least one fence-post board-expansion internal gap, said u-shaped-rail board-expansion internal gap is for:

accommodating expansion and contraction of said stackable interlocking fence-boards inside said u-shaped-rail board-expansion internal gap of said board-expansion-internal-gap rail, to prevent said stackable interlocking fence-boards from warping, bending, and breaking;

allowing deep insertion of said stackable interlocking fence-boards into said u-shaped-rail board-expansion internal gap of said board-expansion-internal-gap rail, to reinforce the springable hand-free-self-locking self-centering bracket-clamp fence system, supporting said stackable interlocking fence-boards, and locking said stackable-interlocking-fence-board ridge therein, said stackable-interlocking-fence-board body is for creating a barrier and for providing privacy, said stackable-interlocking-fence-board first end is for sliding into said fence-post board-expansion internal gap, said stackable-interlocking-fence-board second end is for sliding into said fence-post board-expansion internal gap, said stackable-interlocking-fence-board slot is for stacking on and locking on said stackable-interlocking-fence-board ridge, said stackable-interlocking-fence-board ridge is for stacking under and locking in said stackable-interlocking-fence-board slot, said fence-post has fence-post sharp edges, said fence-post-covering cap is for covering said fence-post:

to prevent water penetration into said fence-post;

to cover said fence-post sharp edges; and to prevent personal injuries, whereby the springable hand-free-self-locking self-centering bracket-clamp fence system:

can squeeze said at least one springable hand-free-self-locking self-centering bracket-clamp jaw therein, can lock said at least one springable hand-free-self-locking self-centering bracket-clamp jaw therein, can center said at least one springable hand-free-self-locking self-centering bracket-clamp groove therein, can center said at least one springable hand-free-self-locking self-centering bracket-clamp tooth therein, can center said at least one springable hand-free-self-locking self-centering bracket-clamp jaw therein, can center said at least one springable hand-free-self-locking self-centering bracket-clamp body therein, can center said springable hand-free-self-locking self-centering bracket-clamps therein, can center said board-expansion-internal-gap rails, can center said stackable interlocking fence-boards, can accommodate expansion and contraction of said stackable interlocking fence-boards inside said at least one fence-post board-expansion internal gap, to prevent said stackable interlocking fence-boards from warping, bending, and breaking, can allow deep insertion of said stackable interlocking fence-boards into said at least one fence-post board-expansion internal gap, to eliminate the empty space created when said stackable interlocking fence-boards contract under cold weather between said stackable interlocking fence-boards and said fence-post to provide seamless barriers for privacy and to reinforce the springable hand-free-self-locking self-centering bracket-clamp fence system.

2. The springable hand-free-self-locking self-centering bracket-clamp fence system of claim 1, further, comprising at least one springable hand-free-self-locking self-centering bracket-body hole drilled in said springable hand-free-self-locking self-centering bracket-clamp body for one of said at least one bracket-clamp screw to screw therethrough.

3. The springable hand-free-self-locking self-centering bracket-clamp fence system of claim 1, further, comprising at least one springable hand-free-self-locking self-centering bracket-clamp hole drilled in said at least one springable hand-free-self-locking self-centering bracket-clamp groove for one of said at least one bracket-clamp screw to screw therethrough.

4. The springable hand-free-self-locking self-centering bracket-clamp fence system of claim 1, wherein, said at least one springable hand-free-self-locking self-centering bracket-clamp tooth comprises six opposite teeth.

5. The springable hand-free-self-locking self-centering bracket-clamp fence system of claim 1, wherein, said at least one springable hand-free-self-locking self-centering bracket-clamp jaw comprises two opposite jaws.

6. The springable hand-free-self-locking self-centering bracket-clamp fence system of claim 1, wherein, said at least one bracket-clamp screw comprises tapping screws.

7. The springable hand-free-self-locking self-centering bracket-clamp fence system of claim 1, wherein, said at least one bracket-clamp-centering groove comprises four grooves.

8. The springable hand-free-self-locking self-centering bracket-clamp fence system of claim 1, wherein, said at least one post-locking shaft hole comprises four holes.

9. The springable hand-free-self-locking self-centering bracket-clamp fence system of claim 1, wherein, one of said springable hand-free-self-locking self-centering bracket-clamp systems is assembled right side up, and another one of said springable hand-free-self-locking self-centering bracket-clamp systems is assembled upside down.

10. A self-locking self-centering bracket-clamp fence system comprising:

a fence-post base comprising:

a post-supporting base, and at least one base screw;

a fence-post comprising:

a plurality of fence-post external walls, a plurality of fence-post internal walls, at least one bracket-clamp-locking jaw slot, at least one bracket-clamp-centering groove, at least one post-locking hole, and at least one fence-post board-expansion internal gap;

a plurality of self-locking self-centering bracket-clamps, each comprising:

a self-locking self-centering bracket-clamp body, at least one self-locking self-centering bracket-clamp jaw, at least one self-locking self-centering bracket-clamp tooth, at least one self-locking self-centering bracket-clamp groove, and at least one bracket-clamp screw;

two board-expansion-internal-gap rails, each comprising:

a u-shaped-rail body, a u-shaped-rail first end, a u-shaped-rail second end, and a u-shaped-rail board-expansion internal gap;

a plurality of stackable interlocking fence-boards, each comprising:

a stackable-interlocking-fence-board body, a stackable-interlocking-fence-board first end, a stackable-interlocking-fence-board second end, a stackable-interlocking-fence-board slot, and a stackable-interlocking-fence-board ridge; and a fence-post-covering cap, comprising:

a fence-post-covering cap body, a fence-post-covering-cap central lock, a fence-post-covering-cap perimeter lock, and wherein:

said fence-post base is screwed to said fence-post, said at least one base screw is screwed through said fence-post base and into said at least one post-locking hole to attach said fence-post base to said fence-post, said fence-post external walls each are molded to another one of said fence-post external walls and to one of said fence-post internal walls to form a square-cross-sectional post such that:

each of said at least one bracket-clamp-locking jaw slot is formed between two of said fence-post external walls and between two of said fence-post internal walls, each of said at least one bracket-clamp-centering groove is formed in one of said fence-post internal walls and is engaged to one of said at least one bracket-clamp-locking jaw slot, each of said at least one post-locking hole is formed along where every two adjacent ones of said fence-post external walls are molded to each other, and each of said at least one fence-post board-expansion internal gap is formed between two of said fence-post internal walls and is engaged to one of said at least one bracket-clamp-locking jaw slot, said sell-locking sell-centering bracket-clamps are screwed to said fence-post and to said stackable interlocking fence-boards, said self-locking self-centering bracket-clamp body has a body end, said at least one self-locking self-centering bracket-clamp jaw has two opposite jaw ends, said body end of said self-locking self-centering bracket-clamp body is molded to said at least one self-locking self-centering bracket-clamp jaw between said two opposite jaw ends, said at least one self-locking self-centering bracket-clamp tooth are molded to said two opposite jaw ends, said at least one self-locking self-centering bracket-clamp groove is formed in said at least one self-locking self-centering bracket-clamp jaw between said two opposite jaw ends, said self-locking self-centering bracket-clamp body is inserted into one of said at least one fence-post board-expansion internal gap and is screwed on one of said u-shaped-rail first end and said u-shaped-rail first end by using one of said at least one bracket-clamp screw, said at least one self-locking self-centering bracket-clamp groove is aligned with one of said at least one bracket-clamp-centering groove, said at least one self-locking self-centering bracket-clamp jaw is inserted into one of said at least one bracket-clamp-locking jaw slot and is screwed on one of said fence-post internal walls by using another one of said at least one bracket-clamp screw, said two board-expansion-internal-gap rails are screwed to said two self-locking self-centering bracket-clamps, respectively, said u-shaped-rail body is molded to said u-shaped-rail first end and said u-shaped-rail second end to create said u-shaped-rail board-expansion internal gap therein, said stackable interlocking fence-boards are slid into said at least one fence-post board-expansion internal gap and into said u-shaped-rail board-expansion internal gap, respectively, said stackable-interlocking-fence-board body is molded to said stackable-interlocking-fence-board first end, said stackable-interlocking-fence-board second end, said stackable-interlocking-fence-board slot, and said stackable-interlocking-fence-board ridge, said fence-post-covering cap has a center and a perimeter, said fence-post-covering cap is press-locked on said fence-post, said fence-post-covering-cap central lock is molded to said fence-post-covering cap body in said center, said fence-post-covering-cap perimeter locks is molded to said fence-post-covering cap body along said perimeter, wherein:

said post-supporting base is for supporting said fence-post, said base screws are for screwing through said post-supporting base into said at least one post-locking hole, said fence-post external walls are for supporting said fence-post internal walls, said fence-post internal walls are for supporting said fence-post external walls, said at least one bracket-clamp-locking jaw slot is for:

squeezing said at least one self-locking self-centering bracket-clamp jaw therein, and locking said at least one self-locking self-centering bracket-clamp jaw therein, said at least one bracket-clamp-centering groove is for:

centering said at least one self-locking self-centering bracket-clamp groove therein, centering said at least one self-locking self-centering bracket-clamp tooth therein, centering said at least one self-locking self-centering bracket-clamp jaw therein, centering said at least one self-locking self-centering bracket-clamp body therein, centering said self-locking self-centering bracket-clamps therein, centering said board-expansion-internal-gap rails, and centering said stackable interlocking fence-boards, said at least one post-locking hole is for screwing said base screws therein, said at least one fence-post board-expansion internal gap is for:

accommodating expansion and contraction of said stackable interlocking fence-boards inside said at least one fence-post board-expansion internal gap of said fence-post, to prevent said stackable interlocking fence-boards from warping, bending, and breaking, and allowing deep insertion of said stackable interlocking fence-boards into said at least one fence-post board-expansion internal gap of said fence-post, to eliminate the empty space created when said stackable interlocking fence-boards contract under cold weather between said stackable interlocking fence-boards and said fence-post to provide seamless barriers for privacy and to reinforce the self-locking self-centering bracket-clamp fence system, said self-locking self-centering bracket-clamp body is for attaching said board-expansion-internal-gap rails to said at least one self-locking self-centering bracket-clamp jaw, said at least one self-locking self-centering bracket-clamp jaw is for:

being squeezed into said at least one bracket-clamp-locking jaw slot, springably and temporarily securing said self-locking self-centering bracket-clamps in place, to eliminate the need for holding it while screwing it to said fence-post, reducing fence-installing time, by eliminating the need for manually holding said self-locking self-centering bracket-clamps while installing the self-locking self-centering bracket-clamp fence system, and functioning as a springably locking washer to springably lock said at least one bracket-clamp screw to said fence-post, said at least one self-locking self-centering bracket-clamp tooth is for biting into said at least one jaw slot, said at least one self-locking self-centering bracket-clamp groove is for:

sliding in said at least one bracket-clamp-centering groove, centering said at least one self-locking self-centering bracket-clamp tooth therein, centering said at least one self-locking self-centering bracket-clamp jaw therein, centering said self-locking self-centering bracket-clamp body therein, and centering said self-locking self-centering bracket-clamps therein, said at least one bracket-clamp screw is for screwing through said at least one self-locking self-centering bracket-clamp groove into said fence-post, to secure said self-locking self-centering bracket-clamps to said fence-post, said u-shaped-rail body is for supporting said stackable interlocking fence-boards, said u-shaped-rail first end is for inserting into said at least one fence-post board-expansion internal gap, said u-shaped-rail second end is for inserting into said at least one fence-post board-expansion internal gap, said u-shaped-rail board-expansion internal gap is for:

accommodating expansion and contraction of said stackable interlocking fence-boards inside said u-shaped-rail board-expansion internal gap of said board-expansion-internal-gap rails, to prevent said stackable interlocking fence-boards from warping, bending, and breaking;

allowing deep insertion of said stackable interlocking fence-boards into said u-shaped-rail board-expansion internal gap of said board-expansion-internal-gap rails, to reinforce the self-locking self-centering bracket-clamp fence system, supporting said stackable interlocking fence-boards, and locking said stackable-interlocking-fence-board ridge therein, said stackable-interlocking-fence-board body is for creating a barrier and for providing privacy, said stackable-interlocking-fence-board first end is for sliding into said fence-post board-expansion internal gap, said stackable-interlocking-fence-board second end is for sliding into said fence-post board-expansion internal gap, said stackable-interlocking-fence-board slot is for stacking on and locking on said stackable-interlocking-fence-board ridge, said stackable-interlocking-fence-board ridge is for stacking under and locking in said stackable-interlocking-fence-board slot, said fence-post system has fence-post sharp edges, said fence-post-covering cap is for covering said fence-post:

to prevent water penetration into said fence-post;

to cover said fence-post sharp edges; and to prevent personal injuries, whereby the self-locking self-centering bracket-clamp fence system:

can squeeze said at least one self-locking self-centering bracket-clamp jaw therein, can lock said at least one self-locking self-centering bracket-clamp jaw therein, can center said at least one self-locking self-centering bracket-clamp groove therein, can center said at least one self-locking self-centering bracket-clamp tooth therein, can center said at least one self-locking self-centering bracket-clamp jaw therein, can center said at least one self-locking self-centering bracket-clamp body therein, can center said self-locking self-centering bracket-clamps therein, can center said board-expansion-internal-gap rails, can center said stackable interlocking fence-boards, can accommodate expansion and contraction of said stackable interlocking fence-boards inside said at least one fence-post board-expansion internal gap, to prevent said stackable interlocking fence-boards from warping, bending, and breaking, can allow deep insertion of said stackable interlocking fence-boards into said at least one fence-post board-expansion internal gap, to eliminate the empty space created when said stackable interlocking fence-boards contract under cold weather between said stackable interlocking fence-boards and said fence-post to provide seamless barriers for privacy and to reinforce the self-locking self-centering bracket-clamp fence system.

11. The self-locking self-centering bracket-clamp fence system of claim 10, further, comprising at least one self-locking self-centering bracket-body hole drilled in said self-locking self-centering bracket-clamp body for one of said at least one bracket-clamp screw to screw therethrough.

12. The self-locking self-centering bracket-clamp fence system of claim 10, further, comprising at least one self-locking self-centering bracket-clamp hole drilled in said at least one self-locking self-centering bracket-clamp groove for one of said at least one bracket-clamp screw to screw therethrough.

13. The self-locking self-centering bracket-clamp fence system of claim 10, wherein, said at least one self-locking self-centering bracket-clamp tooth comprises six opposite teeth.

14. The self-locking self-centering bracket-clamp fence system of claim 10, wherein, said at least one self-locking self-centering bracket-clamp jaw comprises two opposite jaws.

15. The self-locking self-centering bracket-clamp fence system of claim 10, wherein, said at least one bracket-clamp screw comprises tapping screws.

16. The self-locking self-centering bracket-clamp fence system of claim 10, wherein, said at least one bracket-clamp-centering groove comprises four grooves.

17. The self-locking self-centering bracket-clamp fence system of claim 10, wherein, said at least one post-locking hole comprises four holes.

18. The self-locking self-centering bracket-clamp fence system of claim 10, wherein, one of said self-locking sell-centering bracket-clamps is assembled right side up, and another one of said self-locking self-centering bracket-clamps is assembled upside down.

19. A springable self-centering bracket-clamp fence system comprising:

a fence-post base comprising:

a post-supporting base, and at least one base screw;

a fence-post comprising:

a plurality of fence-post external walls, a plurality of fence-post internal walls,
at least one bracket-clamp-locking jaw slot,
at least one bracket-clamp-centering groove,
at least one post-locking hole, and
at least one fence-post board-expansion internal gap;
a plurality of springable self-centering bracket-clamps, each comprising:
a springable self-centering bracket-clamp body,
at least one springable self-centering bracket-clamp jaw,
at least one springable self-centering bracket-clamp tooth,
at least one springable self-centering bracket-clamp groove, and
at least one bracket-clamp screw;
two board-expansion-internal-gap rails, each comprising:
a u-shaped-rail body,
a u-shaped-rail first end,
a u-shaped-rail second end, and
a u-shaped-rail board-expansion internal gap;
a plurality of stackable interlocking fence-boards, each comprising:
a stackable-interlocking-fence-board body,
a stackable-interlocking-fence-board first end,
a stackable-interlocking-fence-board second end,
a stackable-interlocking-fence-board slot, and
a stackable-interlocking-fence-board ridge; and
a fence-post-covering cap, comprising:
a fence-post-covering cap body,
a fence-post-covering-cap central lock, and
a fence-post-covering-cap perimeter lock,
wherein:
said fence-post base is screwed to said fence-post,
said at least one base screw is screwed through said fence-post base and into said at least one post-locking hole to attach said fence-post base to said fence-post,
said fence-post external walls each are molded to another one of said fence-post external walls and to one of said fence-post internal walls to form a square-cross-sectional post such that:
each of said at least one bracket-clamp-locking jaw slot is formed between two of said fence-post external walls and between two of said fence-post internal walls,
each of said at least one bracket-clamp-centering groove is formed in one of said fence-post internal walls and is engaged to one of said at least one bracket-clamp-locking jaw slot,
each of said at least one post-locking hole is formed along where every two adjacent ones of said fence-post external walls are molded to each other, and
each of said at least one fence-post board-expansion internal gap is formed between two of said fence-post internal walls and is engaged to one of said at least one bracket-clamp-locking jaw slot,
said springable self-centering bracket-clamps are screwed to said fence-post and to said stackable interlocking fence-boards,
said springable self-centering bracket-clamp body has a body end,
said at least one springable self-centering bracket-clamp jaw has two opposite jaw ends,
said body end of said springable self-centering bracket-clamp body is molded to said at least one springable self-centering bracket-clamp jaw between said two opposite jaw ends,
said at least one springable self-centering bracket-clamp tooth are molded to said two opposite jaw ends,
said at least one springable self-centering bracket-clamp groove is formed in said at least one springable self-centering bracket-clamp jaw between said two opposite jaw ends,
said springable self-centering bracket-clamp body is inserted into one of said at least one fence-post board-expansion internal gap and is screwed on one of said u-shaped-rail first end and said u-shaped-rail second end by using one of said at least one bracket-clamp screw,
said at least one springable self-centering bracket-clamp groove is aligned with one of said at least one bracket-clamp-centering groove,
said at least one springable self-centering bracket-clamp jaw is inserted into one of said at least one bracket-clamp-locking jaw slot and is screwed on one of said fence-post internal walls by using another one of said at least one bracket-clamp screw,
said fence-post external walls are molded to said fence-post internal walls to form said at least one bracket-clamp-locking jaw slot, said at least one bracket-clamp-centering groove, and said at least one fence-post board-expansion internal gap,
said two springable self-centering bracket-clamps are screwed to said fence-post and to said stackable interlocking fence-boards,
said springable self-centering bracket-clamp body is molded to said at least one springable self-centering bracket-clamp jaw, said at least one springable self-centering bracket-clamp tooth, and said at least one springable self-centering bracket-clamp groove,
said two board-expansion-internal-gap rails are screwed to said two springable self-centering bracket-clamps, respectively,
said u-shaped-rail body is molded to said u-shaped-rail first end and said u-shaped-rail second end to create said u-shaped-rail board-expansion internal gap therein,
said stackable interlocking fence-boards are slid into said at least one fence-post board-expansion internal gap and into said u-shaped-rail board-expansion internal gap, respectively,
said stackable-interlocking-fence-board body is molded to said stackable-interlocking-fence-board first end, said stackable-interlocking-fence-board second end, said stackable-interlocking-fence-board slot, and said stackable-interlocking-fence-board ridge,
said fence-post-covering cap has a center and a perimeter,
said fence-post-covering cap is press-locked on said fence-post,
said fence-post-covering-cap central lock is molded to said fence-post-covering cap body in said center,
said fence-post-covering-cap perimeter locks is molded to said fence-post-covering cap body along said perimeter,
wherein:
said fence-post base is for supporting said fence-post,
said at least one base screw is for screwing through said post-supporting base into said at least one post-locking hole,
said fence-post external walls are for supporting said fence-post internal walls,
said fence-post internal walls are for supporting said fence-post external walls,
said at least one bracket-clamp-locking jaw slot is for:
squeezing said at least one springable self-centering bracket-clamp jaw therein, and locking said at least one springable self-centering bracket-clamp jaw therein, said at least one bracket-clamp-centering groove is for:

centering said at least one springable self-centering bracket-clamp groove therein, centering said at least one springable self-centering bracket-clamp tooth therein, centering said at least one springable self-centering bracket-clamp jaw therein, centering said at least one springable self-centering bracket-clamp body therein, centering said springable self-centering bracket-clamps therein, centering said board-expansion-internal-gap rails, and centering said stackable interlocking fence-boards, said at least one post-locking hole is for screwing said at least one base screw therein, said at least one fence-post board-expansion internal gap is for:

accommodating expansion and contraction of said stackable interlocking fence-boards inside said at least one fence-post board-expansion internal gap of said fence-post, to prevent said stackable interlocking fence-boards from warping, bending, and breaking, and allowing deep insertion of said stackable interlocking fence-boards into said at least one fence-post board-expansion internal gap of said fence-post, to eliminate the empty space created when said stackable interlocking fence-boards contract under cold weather between said stackable interlocking fence-boards and said fence-post to provide seamless barriers for privacy and to reinforce the springable self-centering bracket-clamp fence system, said springable self-centering bracket-clamp body is for attaching said board-expansion-internal-gap rails to said at least one springable self-centering bracket-clamp jaw, said at least one springable self-centering bracket-clamp jaw is for:

being squeezed into said at least one bracket-clamp-locking jaw slot, springably and temporarily securing said springable self-centering bracket-clamps in place, to eliminate the need for holding it while screwing it to said fence-post, and reducing fence-installing time, by eliminating the need for manually holding said springable self-centering bracket-clamps while installing the springable self-centering bracket-clamp fence system, said at least one springable self-centering bracket-clamp tooth is for biting into said at least one jaw slot, said at least one springable self-centering bracket-clamp groove is for:

sliding in said at least one bracket-clamp-centering groove, centering said at least one springable self-centering bracket-clamp tooth therein, centering said at least one springable self-centering bracket-clamp jaw therein, centering said springable self-centering bracket-clamp body therein, and centering said springable self-centering bracket-clamps therein, said at least one bracket-clamp screw is for screwing through said at least one springable self-centering bracket-clamp groove into said fence-post, to secure said springable self-centering bracket-clamps to said fence-post, said u-shaped-rail body is for supporting said stackable interlocking fence-boards, said u-shaped-rail first end is for inserting into said at least one fence-post board-expansion internal gap, said u-shaped-rail second end is for inserting into said at least one fence-post board-expansion internal gap, said u-shaped-rail board-expansion internal gap is for:

accommodating expansion and contraction of said stackable interlocking fence-boards inside said u-shaped-rail board-expansion internal gap of said board-expansion-internal-gap rails, to prevent said stackable interlocking fence-boards from warping, bending, and breaking;

allowing deep insertion of said stackable interlocking fence-boards into said u-shaped-rail board-expansion internal gap of said board-expansion-internal-gap rails, to reinforce the springable self-centering bracket-clamp fence system, supporting said stackable interlocking fence-boards, and locking said stackable-interlocking-fence-board ridge therein, said stackable-interlocking-fence-board body is for creating a barrier and for providing privacy, said stackable-interlocking-fence-board first end is for sliding into said fence-post board-expansion internal gap, said stackable-interlocking-fence-board second end is for sliding into said fence-post board-expansion internal gap, said stackable-interlocking-fence-board slot is for stacking on and locking on said stackable-interlocking-fence-board ridge, said stackable-interlocking-fence-board ridge is for stacking under and locking in said stackable-interlocking-fence-board slot, said fence-post has fence-post sharp edges, said fence-post-covering cap is for covering said fence-post:

to prevent water penetration into said fence-post;

to cover said fence-post sharp edges; and to prevent personal injuries.

20. The springable self-centering bracket-clamp fence system of claim 19, wherein, one of said springable self-centering bracket-clamps is assembled right side up, and another one of said springable self-centering bracket-clamps is assembled upside down.

* * * * *